US010609772B2

(12) United States Patent
Hayashi et al.

(10) Patent No.: US 10,609,772 B2
(45) Date of Patent: Mar. 31, 2020

(54) MICROWAVE HEATING DEVICE

(71) Applicant: Panasonic Intellectual Property Management Co., Ltd., Osaka (JP)

(72) Inventors: Takahiro Hayashi, Shiga (JP); Yuichi Otsuki, Shiga (JP); Seiichi Yamashita, Shiga (JP); Mikio Fukui, Shiga (JP); Toshifumi Kamiya, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 472 days.

(21) Appl. No.: 15/110,567

(22) PCT Filed: Feb. 5, 2015

(86) PCT No.: PCT/JP2015/000510
§ 371 (c)(1),
(2) Date: Jul. 8, 2016

(87) PCT Pub. No.: WO2015/118868
PCT Pub. Date: Aug. 13, 2015

(65) Prior Publication Data

US 2016/0330800 A1 Nov. 10, 2016

(30) Foreign Application Priority Data

Feb. 5, 2014 (JP) ..... 2014-020431

(51) Int. Cl.
*H05B 6/64* (2006.01)
*H05B 6/70* (2006.01)

(52) U.S. Cl.
CPC ..... *H05B 6/642* (2013.01); *H05B 6/645* (2013.01); *H05B 6/6476* (2013.01); *H05B 6/707* (2013.01); *H05B 2206/044* (2013.01)

(58) Field of Classification Search
CPC ..... H05B 6/642; H05B 6/645; H05B 6/6476; H05B 6/64
(Continued)

(56) References Cited

U.S. PATENT DOCUMENTS 4,314,126 A 2/1982 Yoshimura et al.
5,166,487 A 11/1992 Hurley et al.
(Continued)

FOREIGN PATENT DOCUMENTS

FR 2 428 955 A1 1/1980
JP 53-040428 4/1978
(Continued)

OTHER PUBLICATIONS

International Search Report of PCT application No. PCT/JP2015/000510 dated Apr. 7, 2015.
(Continued)

*Primary Examiner* — Dana Ross
*Assistant Examiner* — Ayub A Maye
(74) *Attorney, Agent, or Firm* — Brinks Gilson & Lione

(57) ABSTRACT

In a microwave heating device of the present disclosure, inverter unit drives first and second microwave generators. Cooling unit cools first and second microwave generators and inverter unit. First and second waveguides supplies, to cavity, microwaves generated by first and second microwave generators. First and second microwave generators are disposed side by side in a right-left direction below a bottom surface of cavity. Inverter unit and cooling fan are disposed from the first and second microwave generators toward a front side in order, and first and second waveguides are provided so as to extend in a front-back direction from first and second microwave generators, respectively. According to the present disclosure, the microwave heating device can be further downsized in a right-left direction.

4 Claims, 32 Drawing Sheets

(58) Field of Classification Search
USPC ..... 219/671, 690, 678, 702, 679, 680, 681
See application file for complete search history.

(56) References Cited

U.S. PATENT DOCUMENTS

| | | | | |
|---|---|---|---|---|
| 5,245,149 | A * | 9/1993 | Pinna | B28B 11/241 106/723 |
| 5,483,044 | A * | 1/1996 | Thorneywork | H05B 6/645 126/21 A |
| 9,131,541 | B2 * | 9/2015 | Nordh | H05B 6/642 |
| 9,363,854 | B2 * | 6/2016 | Sim | H05B 6/686 |
| 9,674,903 | B2 * | 6/2017 | Moon | H05B 6/705 |
| 2011/0147376 | A1 * | 6/2011 | Ueda | F24C 15/327 219/682 |

FOREIGN PATENT DOCUMENTS

| | | | |
|---|---|---|---|
| JP | 54-162245 | A | 12/1979 |
| JP | 5-326132 | | 12/1993 |
| JP | 2740411 | B | 4/1998 |
| JP | 2001-319766 | | 11/2001 |
| JP | 2003-074872 | A | 3/2003 |
| JP | 2005-241241 | | 9/2005 |

OTHER PUBLICATIONS

Extended Search Report in corresponding European Application No. 15746895.0, dated Dec. 21, 2016, 9 pages.

* cited by examiner

MICROWAVE HEATING DEVICE

TECHNICAL FIELD

The present disclosure relates to a microwave heating device for heating an object to be heated by microwaves (hereinafter, referred to as microwave heating).

BACKGROUND ART

Conventionally, some microwave heating devices for cooking an object to be heated such as food by microwave heating have two magnetrons (for example, PTL 1). Consequently, it is possible to increase output of microwaves to cook for a short time.

CITATION LIST

Patent Literature

PTL 1: Japanese Patent No. 2740411

SUMMARY OF THE INVENTION

Recently, particularly in a convenience store, a fast food restaurant, and the like, a sufficient space for installing a microwave heating device cannot often be prepared, and therefore it is requested that the microwave heating device is further downsized particularly in a right-left direction and a front-back direction. A conventional configuration is not sufficient to solve this problem, and there is room for improvement.

The present disclosure solves the above problem, and an object of the present disclosure is to downsize a microwave heating device including a plurality of magnetrons.

In order to solve the above problem, a microwave heating device according to the present disclosure includes: a cavity housing an object to be heated; a door openably provided on a front surface of the cavity; first and second microwave generators that generate microwaves; an inverter unit; a cooling unit; and first and second waveguides.

The inverter unit drives the first and second microwave generators. The cooling unit cools the first and second microwave generators and the inverter unit. The first and second waveguides supply, to the cavity, the microwaves generated by the first and second microwave generators.

The first and second microwave generators are disposed side by side in a right-left direction below a bottom surface of the cavity. The inverter unit and the cooling unit are disposed from the first and second microwave generators toward a front side in order, and the first and second waveguides are provided so as to extend in a front-back direction from the first and second microwave generators, respectively.

According to the present disclosure, a microwave heating device including a plurality of magnetrons can be further downsized in a right-left direction.

DESCRIPTION OF EMBODIMENTS

Figure 1:
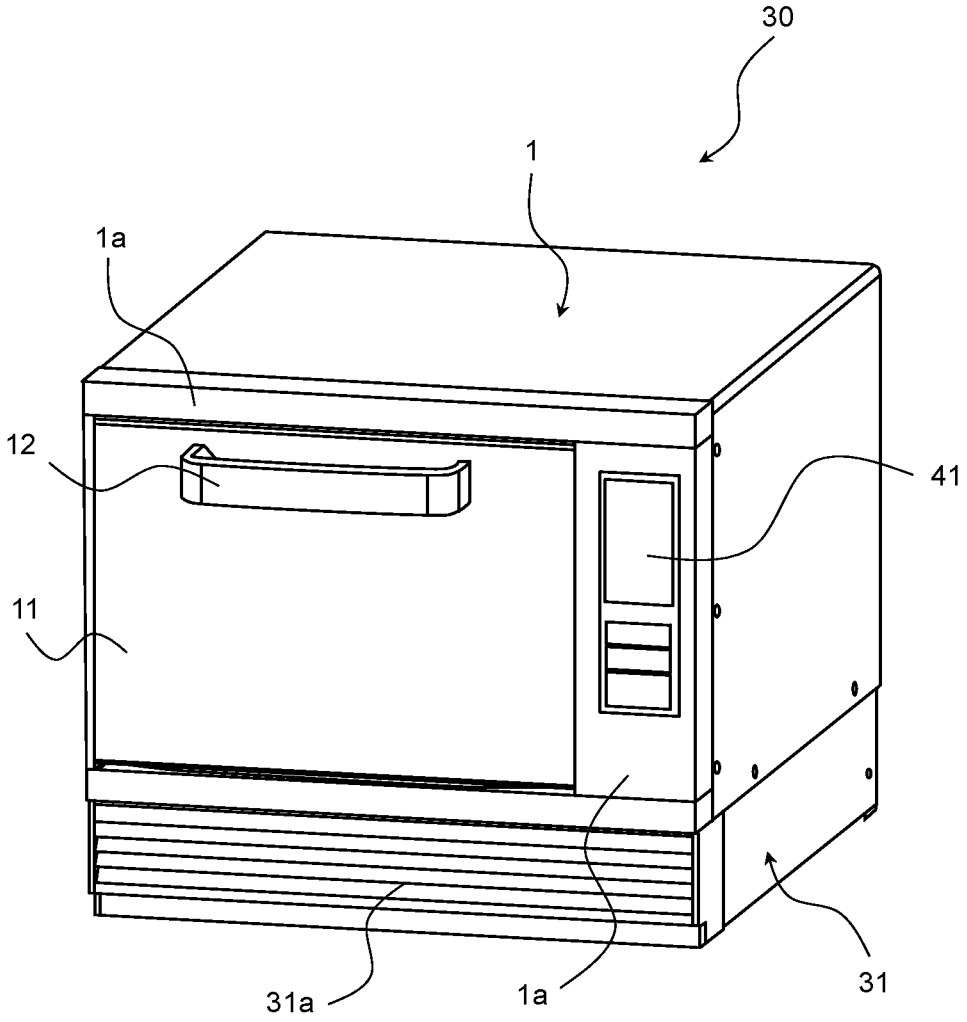
FIG. 1 is a perspective view of a heating cooker according to a first exemplary embodiment of the present disclosure.

A microwave heating device according to a first aspect of the present disclosure includes: a cavity housing an object to be heated; a door openably provided on a front surface of the cavity; first and second microwave generators that generate microwaves; an inverter unit; a cooling unit; and first and second waveguides.

The inverter unit drives the first and second microwave generators. The cooling unit cools the first and second microwave generators and the inverter unit. The first and second waveguides supply, to the cavity, the microwaves generated by the first and second microwave generators.

The first and second microwave generators are disposed side by side in a right-left direction below a bottom surface of the cavity. The inverter unit and the cooling unit are disposed from the first and second microwave generators toward a front side in order, and the first and second waveguides are provided so as to extend in a front-back direction from the first and second microwave generators, respectively.

According to this aspect, in the microwave heating device having a plurality of the microwave generators, it is possible to effectively utilize a space inside a machine chamber. As a result, the microwave heating device can be further downsized in a right-left direction.

According to a microwave heating device of a second aspect of the present disclosure, in the first aspect, the microwave heating device further has a convection device that is provided behind the cavity to be communicated with the cavity, and supplies hot air to the cavity, wherein the first and second microwave generators are provided below the convection device.

According to this aspect, the microwave heating device having a convection heating function can be further downsized in the right-left direction by the utilization of the space inside the machine chamber.

According to a microwave heating device of a third aspect of the present disclosure, in the first aspect, the microwave heating device further has an outside air suction port for taking outside air in, the outside air suction port being provided below the door, wherein the cooling unit and the inverter unit are provided below the cavity.

According to this aspect, the outside air suction port is provided below the door, and therefore it is possible to ensure a suction path of cooling air even in a case where a plurality of the microwave heating devices are disposed side by side in the right-left direction.

According to a microwave heating device of a fourth aspect of the present disclosure, in the first aspect, the first and second waveguides have first and second microwave radiation holes that are openings for supplying microwaves into the cavity, and have H corner shapes curved toward the first and second microwave radiation holes at 90 degrees, respectively.

According to this aspect, the H corner shapes are provided, so that it is possible to improve intensity of the microwaves radiated in the cavity.

Hereinafter, exemplary embodiments of the present disclosure are described with reference to drawings. In the following all drawings, the same or corresponding parts are denoted by the same reference numerals, and overlapping description is omitted.

First Exemplary Embodiment

Figure 2:
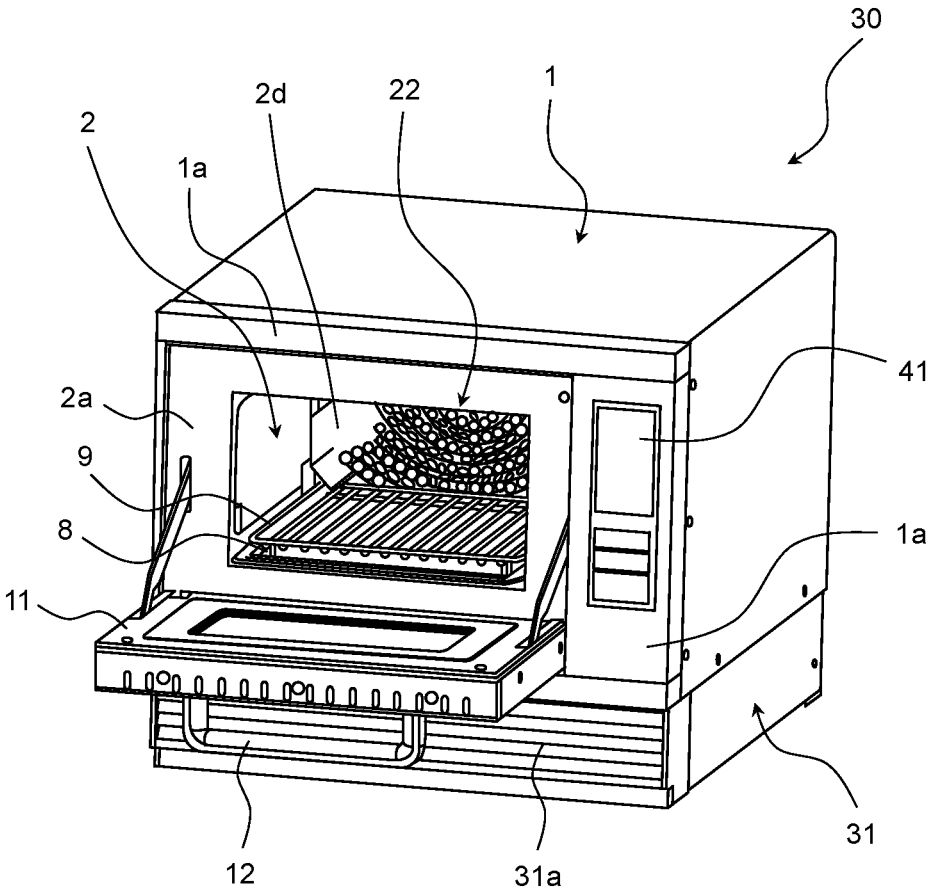
FIG. 2 is a perspective view of the heating cooker according to the first exemplary embodiment.
Figure 3:
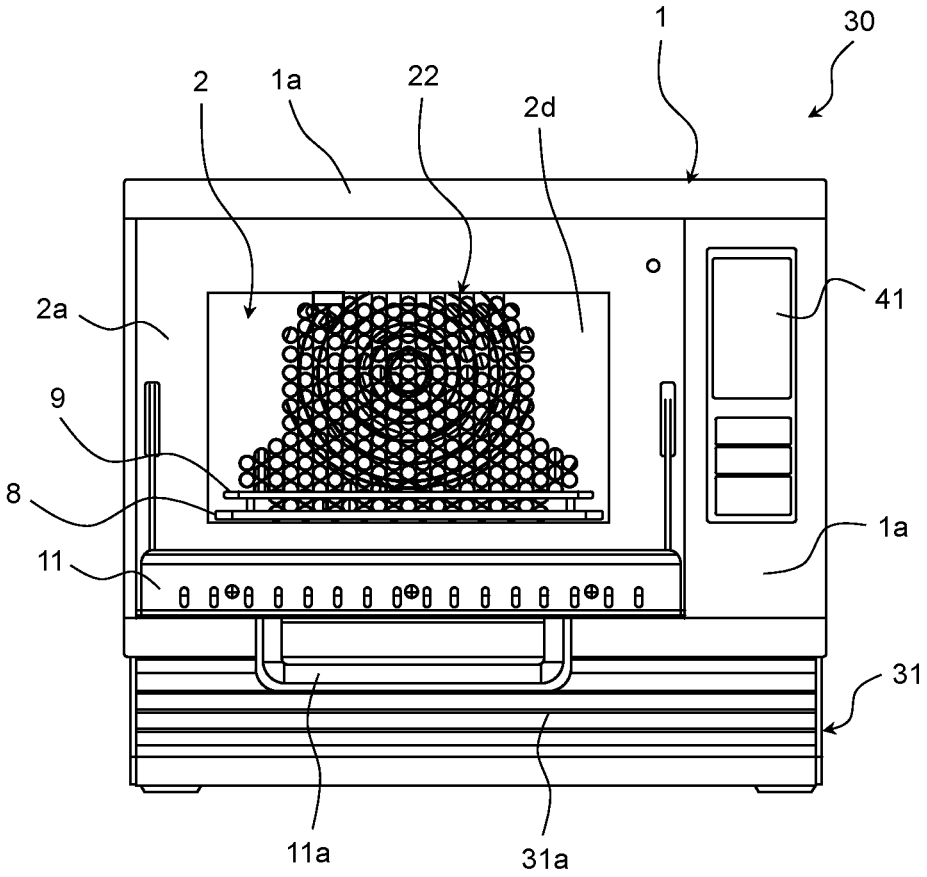
FIG. 3 is a front view of the heating cooker according to the first exemplary embodiment.
Figure 4:
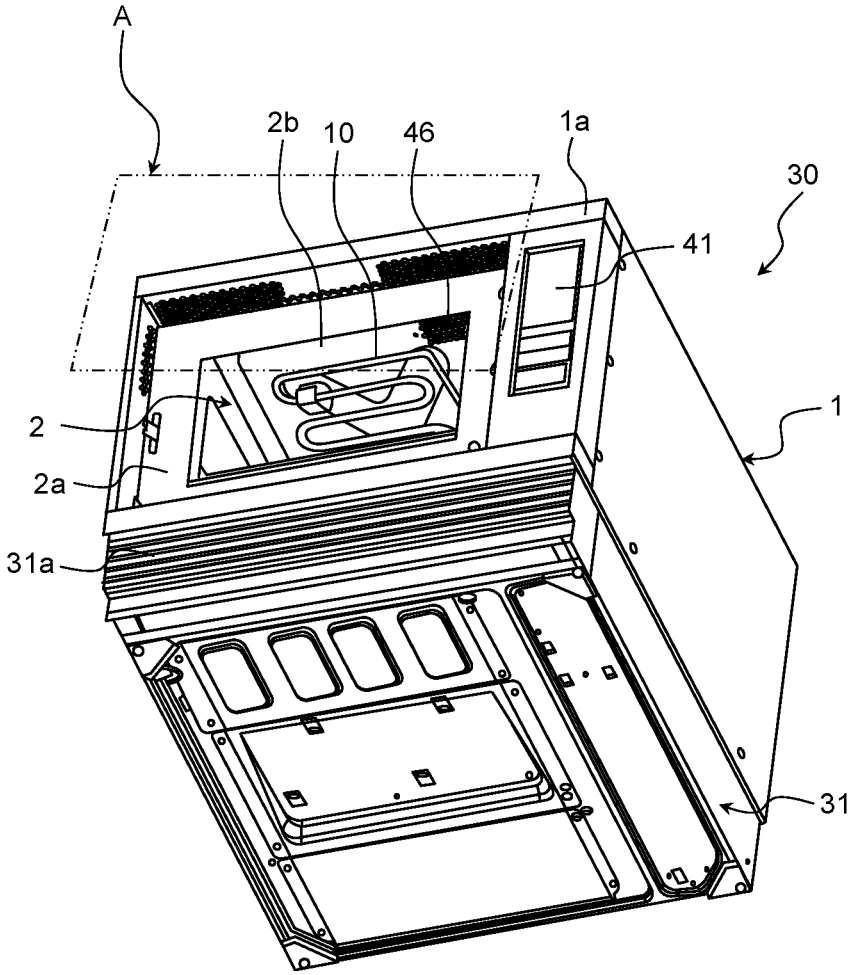
FIG. 4 is a perspective view of the heating cooker according to the first exemplary embodiment.

FIG. 1 to FIG. 4 each are a diagram illustrating appearance of heating cooker 30 according to a first exemplary embodiment of the present disclosure. FIG. 1 is a perspective view of heating cooker 30 with door 11 closed. FIG. 2 is a perspective view of heating cooker 30 with door 11 opened. FIG. 3 is a front view of heating cooker 30 with door 11 opened. FIG. 4 is a perspective view of heating cooker 30 with door 11 detached, as viewed obliquely from a lower part.

Heating cooker 30 according to this exemplary embodiment is particularly a microwave oven for business use used in a convenience store, a fast food restaurant, or the like.

As illustrated in FIG. 1 to FIG. 4, heating cooker 30 includes body 1 that is an outer case, machine chamber 31 for supporting body 1, and door 11 mounted on front surface 1*a* of body 1. As illustrated in FIG. 2 to FIG. 4, cavity 2 is provided inside body 1. Cavity 2 is a housing having a substantially rectangular parallelepiped shape provided with an opening in a single surface in order to house an object to be heated in the housing.

In the following description, a side on which the opening of cavity 2 is provided is defined as a front side of heating cooker 30, and a back side of cavity 2 is defined as a back side of heating cooker 30. Additionally, a right side and a left side as heating cooker 30 is viewed from the front side are referred to as a right side and a left side, respectively.

Door 11 is mounted on front surface 1*a* of body 1 so as to close the opening of cavity 2, and is openably closed with hinges as a center by manipulation of handle 12, the hinges being provided at lower parts on both sides of door 11. An object to be heated inside cavity 2 is heated by a microwave or the like in a state where door 11 is closed (refer to FIG. 1), and the object to be heated is housed in cavity 2, or is taken out of cavity 2 in a state where door 11 is opened (refer to FIG. 2).

Operation part 41 is provided on front surface 1*a* of body 1 on a right side of door 11, and includes buttons and a display screen for manipulation of heating cooker 30 by a user.

As illustrated in FIG. 2 and FIG. 3, wire rack 9 made of stainless steel, and tray 8 made of ceramic (specifically, made of cordierite) are provided inside cavity 2. Wire rack 9 is a placing part formed of a net-like member in order to place an object to be heated. Tray 8 is provided below wire rack 9, and receives fat and the like dripped down from the object to be heated placed on wire rack 9.

As illustrated in FIG. 4, grill heater 10 is provided in a vicinity of ceiling 2*b* inside cavity 2. Grill heater 10 is configured by a single sheathed heater having a bent shape, and heats the inside of cavity 2 by radiant heat. In ceiling 2*b* inside cavity 2, exhaust holes 46 for discharging, to an outside, steam and the like inside cavity 2 is provided. Exhaust duct 42 (not illustrated) described later with reference to FIG. 21, FIG. 22 and the like is connected to exhaust holes 46.

Figure 5A:
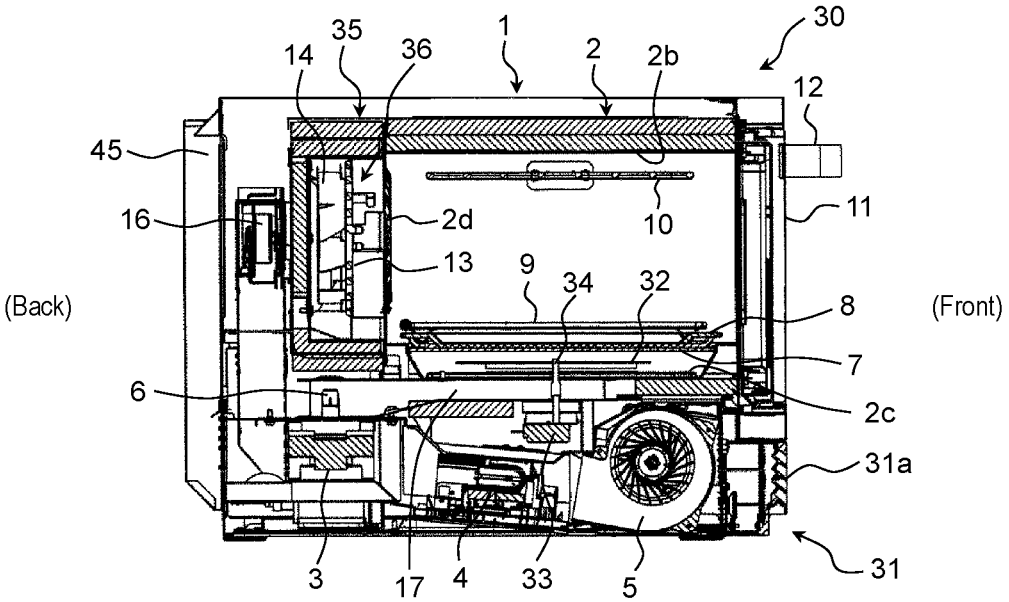
FIG. 5A is a longitudinal sectional view of the heating cooker according to the first exemplary embodiment.

An internal structure of heating cooker 30 is described with reference to FIG. 5A and FIG. 5B. FIG. 5A is a longitudinal sectional view in a front-back direction of heating cooker 30, and FIG. 5B is a partially enlarged sectional view of FIG. 5A.

Figure 5B:
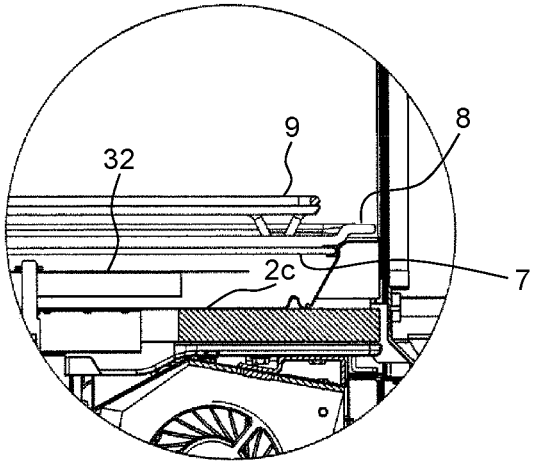
FIG. 5B is a partially enlarged view of FIG. 5A.

As illustrated in FIG. 5A and FIG. 5B, tray 8 is placed on plate receiving base 7. Plate receiving base 7 is provided above bottom surface 2*c* of cavity 2, and supports tray 8. In this exemplary embodiment, plate receiving base 7 is configured by a plate made of ceramic which is capable of transmitting a microwave.

Stirrer 32 is provided between plate receiving base 7 and bottom surface 2*c* of cavity 2, and is a rotator blade that rotates about stirrer shaft 34 in order to stir a microwave. Motor 33 is provided in machine chamber 31, and drives stirrer 32.

In machine chamber 31, microwave generator 3 that generates a microwave, inverter unit 4 that drives microwave generator 3, and cooling unit 5 that cools microwave generator 3 and inverter unit 4 are provided.

Microwave generator 3 is configured by two magnetrons as described later, and generates microwaves supplied into the cavity 2. In this exemplary embodiment, a total output of the two magnetrons is 1200 W to 1300 W.

Waveguide part 17 is connected to microwave generator 3, is provided below bottom surface 2*c* of cavity 2 so as to extend up to stirrer shaft 34 along bottom surface 2*c*, and guides microwaves generated by microwave generator 3 to stirrer shaft 34. Waveguide part 17 is configured by two waveguides as described later.

In an upper surface of waveguide part 17, a hole (not illustrated) for allowing stirrer shaft 34 to pass is provided, and microwave radiation holes (not illustrated) for emitting microwaves are provided in a vicinity of the hole. Details of the microwave radiation holes are described later.

Antenna 6 is provided in waveguide part 17, and transmits, to the microwave radiation holes, microwaves generated by microwave generator 3. The microwaves transmitted into waveguide part 17 by antenna 6 are radiated into cavity 2 through the microwave radiation holes formed in waveguide part 17 and the opening (not illustrated) in bottom surface 2*c*, and are stirred by stirrer 32.

As illustrated in FIG. 5A, inverter unit 4 is disposed in front of microwave generator 3, and drives microwave generator 3. Inverter unit 4 is configured by two inverters as described later.

Cooling unit 5 is disposed in front of inverter unit 4, and cools microwave generator 3 and inverter unit 4. Cooling unit 5 is configured by four cooling fans as described later.

Front grill 31*a* is an outside air suction port for taking outside air into machine chamber 31. Cooling unit 5 takes the outside air from front grill (Front grille) 31*a* of machine chamber 31 to send the outside air backward, so that cooling unit 5 cools inverter unit 4 and microwave generator 3 in order.

Exhaust duct 45 is provided on a back side of body 1, and exhausts, outside heating cooker 30, the air that has cooled inverter unit 4 and microwave generator 3.

A plurality of openings 22 (refer to FIG. 2 and FIG. 3) are formed in back wall 2*d* of cavity 2. Openings 22 in this exemplary embodiment are a plurality of punching holes formed by punching in back wall 2*d*. Convection device 35 for generating hot air to be supplied into cavity 2 is provided behind back wall 2*d*. Convection device 35 is partitioned from cavity 2 by back wall 2*d*, and is communicated with cavity 2 through openings 22.

Figure 6:
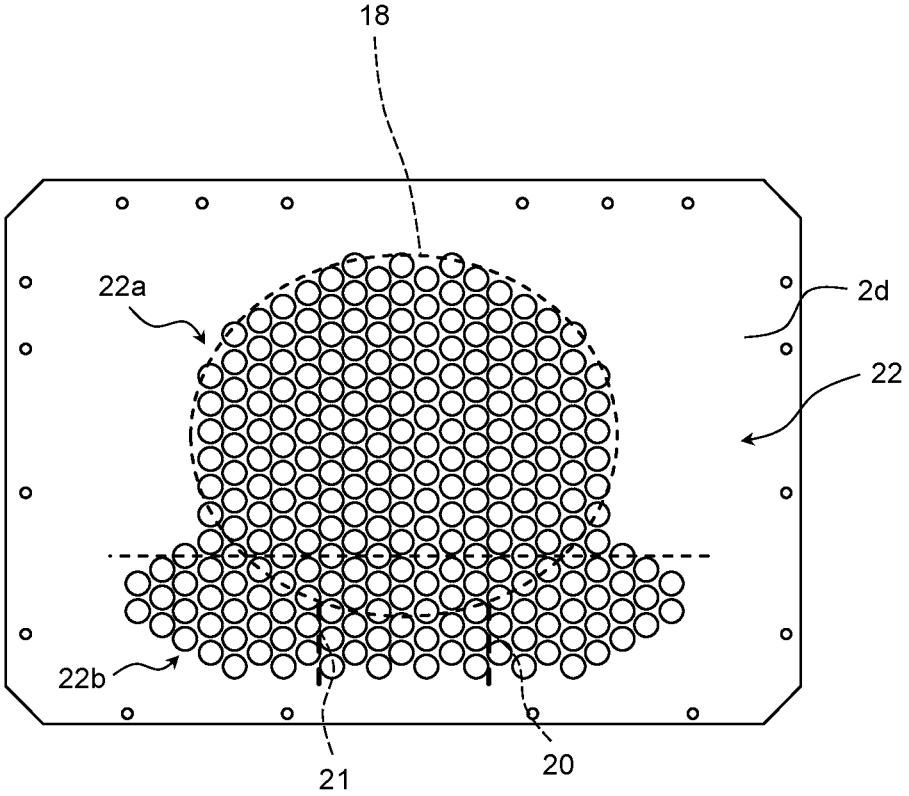
FIG. 6 is a front view of a back wall of a cavity according to the first exemplary embodiment.

A front view of back wall 2*d* is illustrated in FIG. 6. As illustrated in FIG. 6, back wall 2*d* is formed as a substantially rectangular metal plate. Openings 22 include first holes formed as a group of punching holes at a substantially central part of back wall 2*d*, and second holes formed as a group of punching holes below the first holes. The second holes are formed so as to distribute more widely in a right-left direction than the first holes.

As described later, the first holes function as suction ports 22*a* to convection device 35, and the second holes function as discharge ports 22*b* from convection device 35.

While diameters of punching holes in a general convection oven each are substantially 5 mm, a diameter of each suction port 22*a* and a diameter of each discharge port 22*b* in this exemplary embodiment each are about twice, namely 10 mm. Suction ports 22*a* and discharge ports 22*b* are formed so as to have such diameters, so that it is possible to suppress an amount of microwaves passing through openings 22 to leak from cavity 2 to convection device 35 within an allowable range, while minimizing pressure of air when the microwaves pass through opening 22.

As illustrated in FIG. 5A, hot air generation mechanism 36 for generating hot air, which is formed by a plurality of members, is provided in convection device 35. Hot air generation mechanism 36 sucks, into convection device 35, air in cavity 2, and sends out the air in convection device 35 as hot air, into cavity 2. Hot air generation mechanism 36 supplies hot air into cavity 2, so that a circulation flow of the hot air is generated in cavity 2.

According to the above heating configuration of heating cooker 30, heating by radiation using grill heater 10 provided in cavity 2, microwave heating using microwave generator 3, and heating by the circulation flow of hot air using hot air generation mechanism 36 of convection device 35 can be separately or simultaneously performed.

A heater is not disposed below an object to be heated, and therefore liquid such as fat dropping down from the object to be heated never comes into contact with the heater, and smoke or ignition never occurs. An example of a specific operation method of heating cooker 30, which is combined with each of the heating method, is described later.

Now, a configuration of hot air generation mechanism 36 inside convection device 35 is described with reference to FIG. 7 to FIG. 14B.

Figure 7:
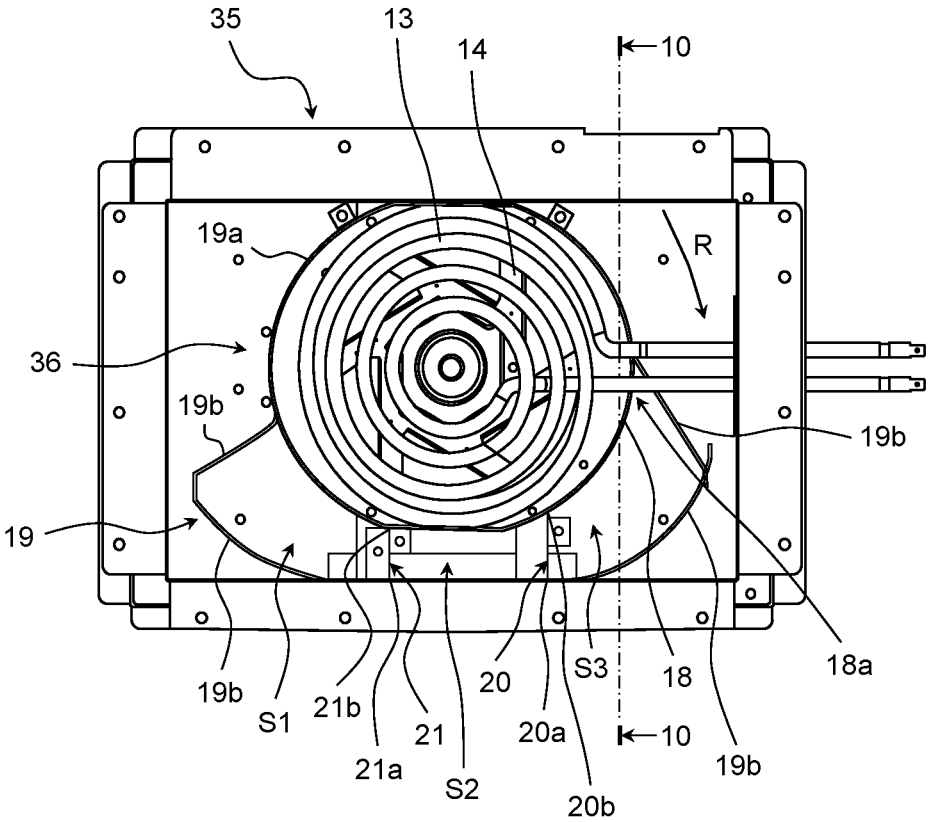
FIG. 7 is a front view of a convection device according to the first exemplary embodiment.
Figure 8:
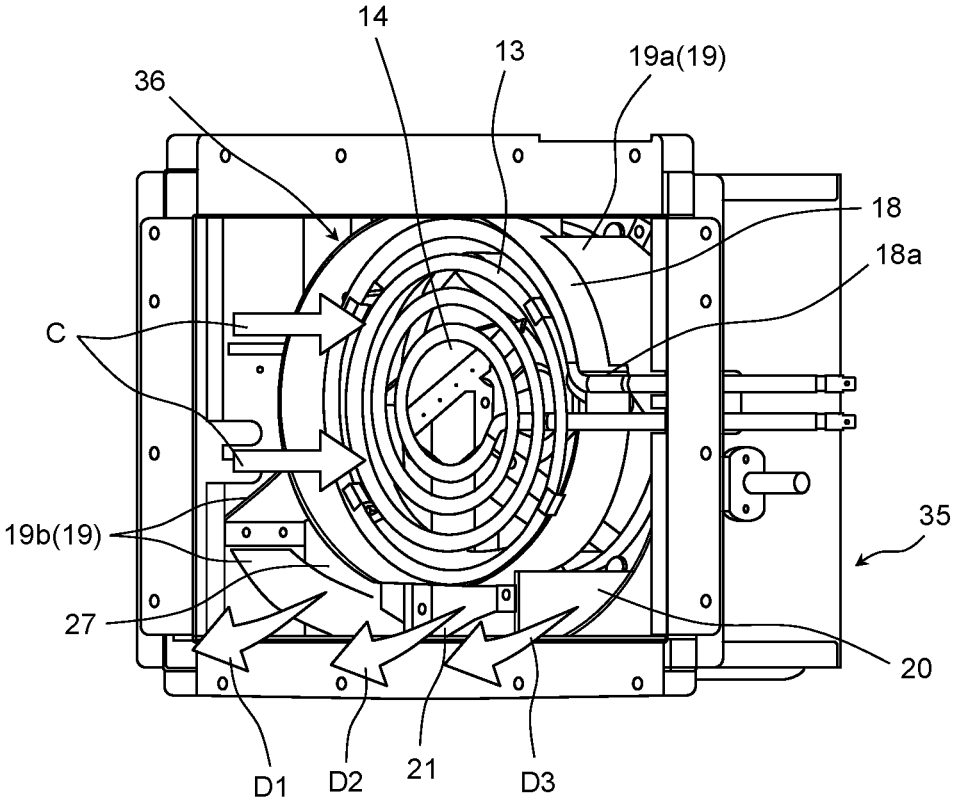
FIG. 8 is a perspective view of the convection device according to the first exemplary embodiment.
Figure 9:
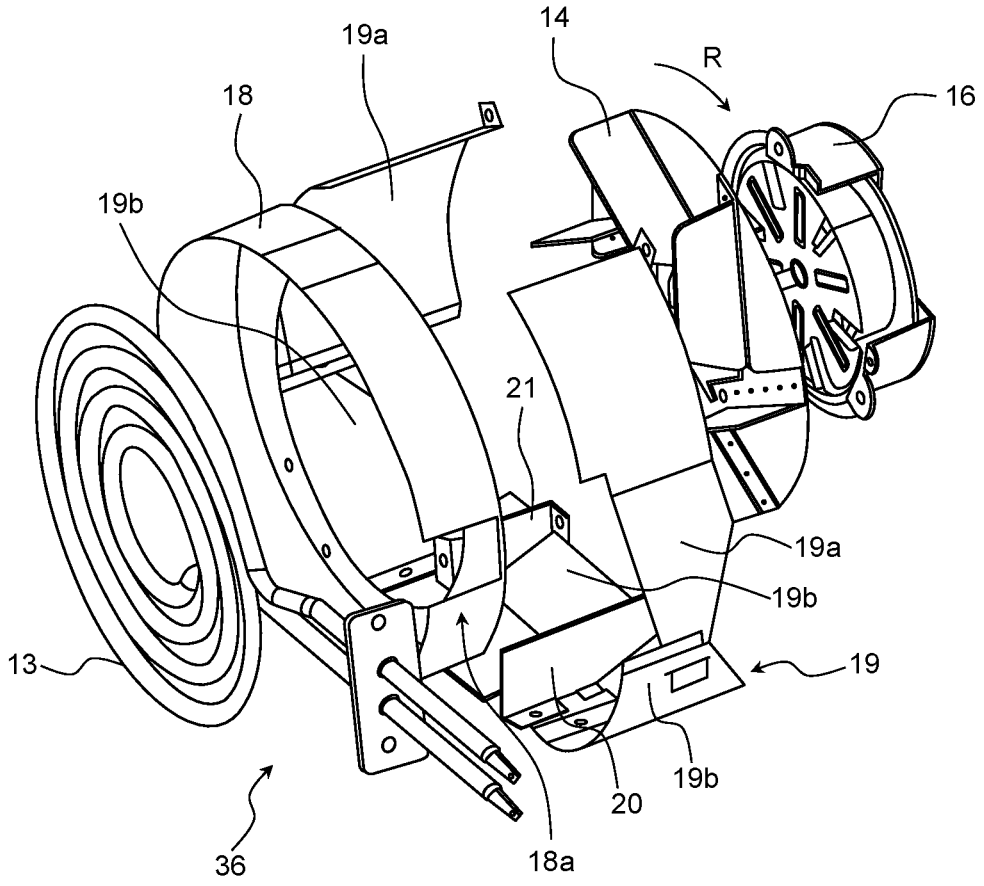
FIG. 9 is an exploded perspective view of a hot air generation mechanism included in the convection device according to the first exemplary embodiment.
Figure 10:
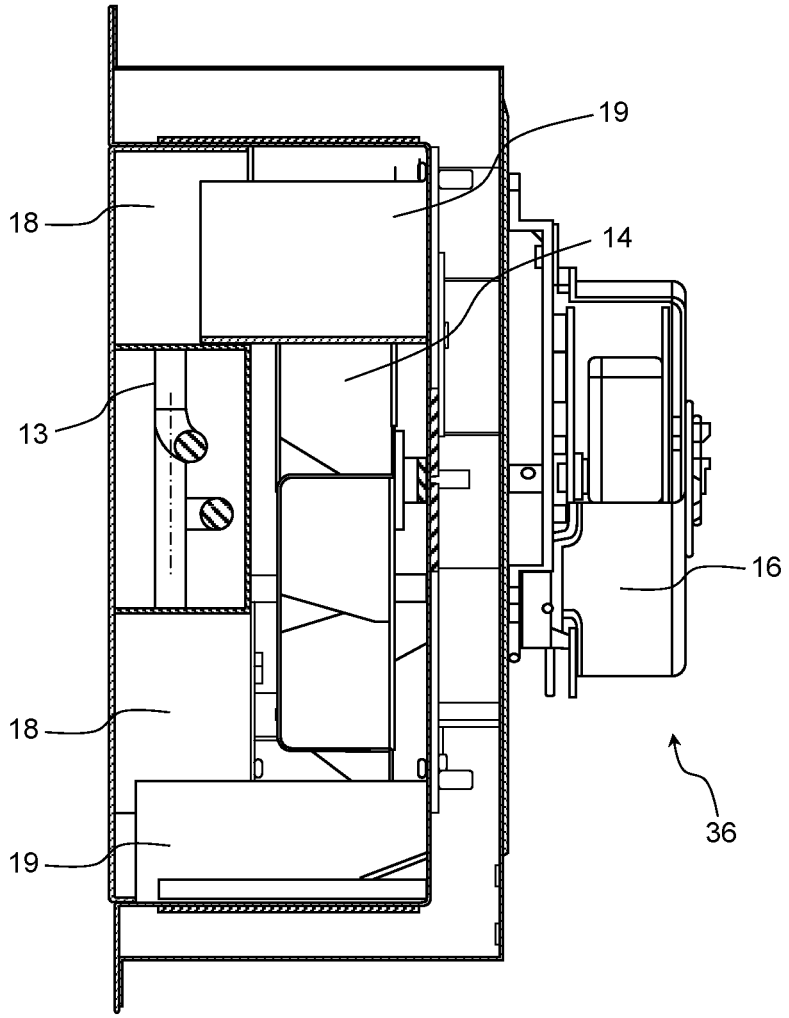
FIG. 10 is a sectional view taken along line 10-10 of FIG. 7.
Figure 11:
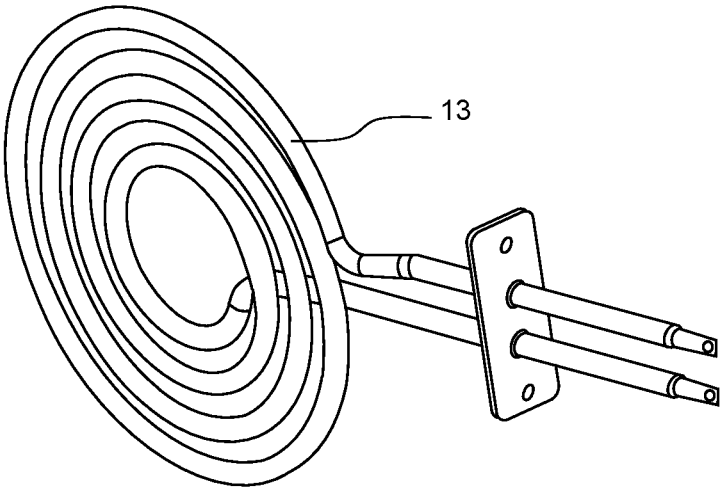
FIG. 11 is a perspective view of a convection heater included in the hot air generation mechanism according to the first exemplary embodiment.
Figure 12:
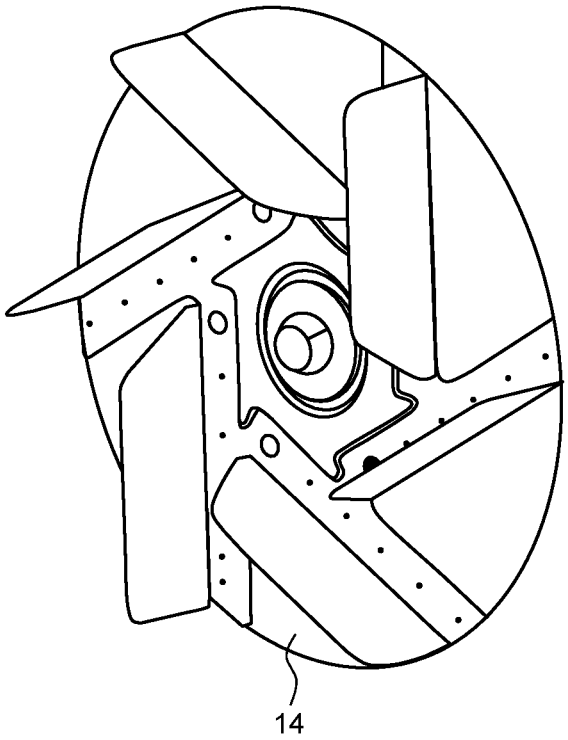
FIG. 12 is a perspective view of a circulation fan included in the convection device according to the first exemplary embodiment.
Figure 13:
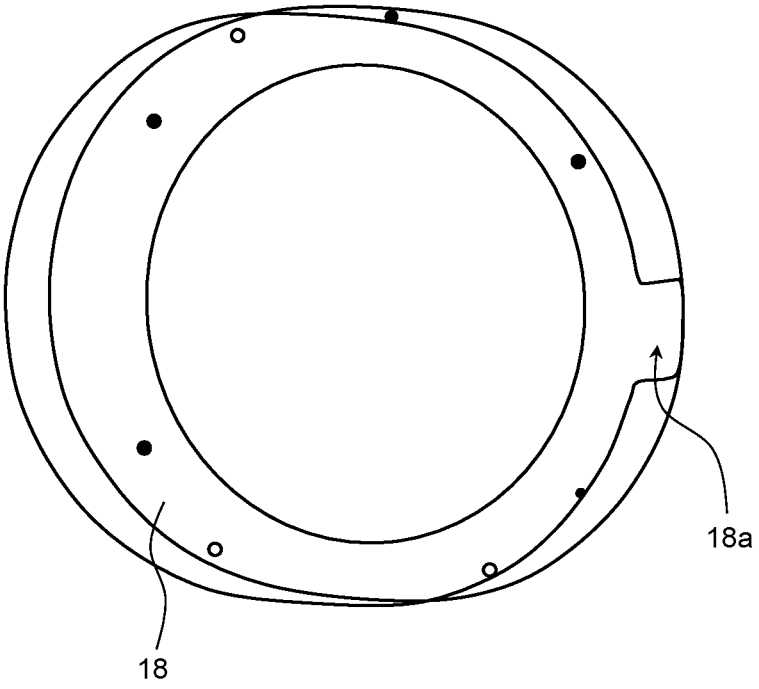
FIG. 13 is a perspective view of an air guide included in the convection device according to the first exemplary embodiment.

FIG. 7 is a front view of convection device 35. FIG. 8 is a perspective view of convection device 35. FIG. 9 is an exploded perspective view of hot air generation mechanism 36 in convection device 35. FIG. 10 is a sectional view taken along line 10-10 of FIG. 7. FIG. 11 to FIG. 14B are perspective views of the respective members forming hot air generation mechanism 36.

As illustrated in FIG. 7 to FIG. 14B, hot air generation mechanism 36 includes convection heater 13, circulation fan 14, fan drive unit 16 (refer to FIG. 9 and FIG. 10) that drives circulation fan 14, air guide 18 that is a first air guide, and air guide 19 that is a second air guide.

Convection heater 13 is provided in convection device 35 in addition to grill heater 10, and heats air in convection device 35. In this exemplary embodiment, convection heater 13 is configured by two sheathed heaters extending from a lateral side of convection device 35, and is formed in a spiral shape at a central part of convection device 35 in order to increase a contact area with air.

Circulation fan 14 is a centrifugal fan that sucks air at a central part, and sends out the sucked air in a centrifugal direction. Circulation fan 14 sucks, into convection device 35, air in cavity 2, and discharges the air in convection device 35 into cavity 2.

Circulation fan 14 is installed behind convection heater 13, and is driven by fan drive unit 16 installed behind circulation fan 14. In this exemplary embodiment, circulation fan 14 rotates in a direction of arrow R (refer to FIG. 7 and FIG. 9), but may rotate in a reverse direction.

Air guide 18 is a member for guiding the air sucked into convection device 35 by circulation fan 14 so as to allow the air to pass through convection heater 13, and is disposed so as to surround convection heater 13. In this exemplary embodiment, air guide 18 is formed in a substantially cylindrical shape. Air guide 18 is formed with cut-away part 18*a* for allowing convection heater 13 disposed inside air guide 18 to extend outside air guide 18.

Air guide 19 is a member for guiding the air sent out by circulation fan 14, and is disposed so as to surround circulation fan 14. In this exemplary embodiment, air guide 19 is disposed so as to be partially in contact with air guide 18 on an outside of air guide 18.

Figure 14A:
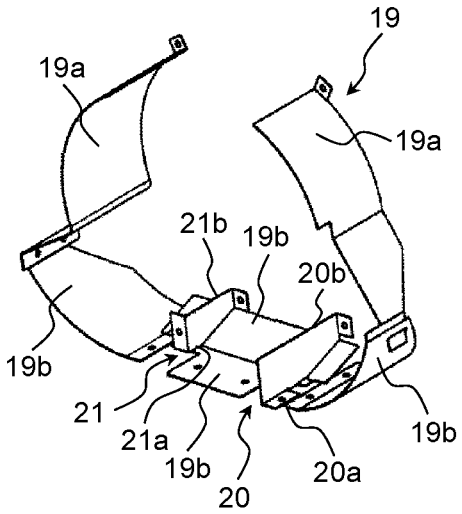
FIG. 14A is a perspective view of the air guide included in the convection device according to the first exemplary embodiment.
Figure 14B:
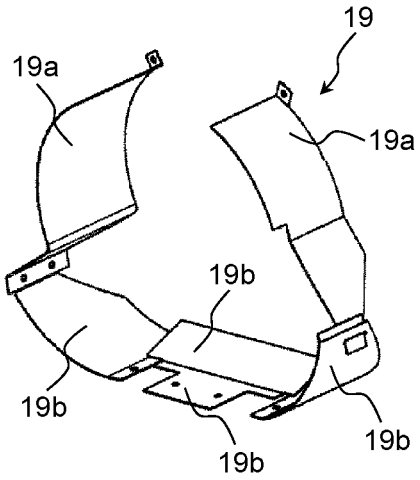
FIG. 14B is a diagram in which first and second wind direction plates are omitted in FIG. 14A.

As illustrated in FIG. 14A and FIG. 14B, air guide 19 is configured by joining parts 19*a* joined to an upper half of air guide 18 from an outside, and isolated parts 19*b* isolated below from air guide 18.

In the above configuration, when fan drive unit 16 drives circulation fan 14, air in cavity 2 is sucked into convection device 35 through suction ports 22*a* of back wall 2*d* (refer to arrows C of FIG. 8). The sucked air is guided to convection heater 13 by air guide 18 to be heated by convection heater 13.

Circulation fan 14 spirally sends out the air heated by convection heater 13 and moving backward. The air sent out by circulation fan 14 is guided to air guide 19 to flow through a space formed between air guide 18 and isolated parts 19*b* of air guide 19 (arrows D1 to D3). Thereafter, the air is sent out to a lower part of the inside of cavity 2 through discharge ports 22*b* of back wall 2*d*, as hot air.

That is, a suction path for air from each suction port 22*a* to circulation fan 14 is formed inside air guide 18, and a discharge path for air from circulation fan 14 to each discharge port 22*b* is formed between air guide 18 and isolated parts 19*b* of air guide 19. Thus, air guide 18 functions as a guide plate for separating the suction path and the discharge path for air in convection device 35.

Isolated parts 19*b* of air guide 19 are provided with wind direction plate 20 that is a first wind direction plate, and wind direction plate 21 that is a second wind direction plate. Wind direction plates 20, 21 extend in the front-back direction so as to direct the hot air spirally sent out by circulation fan 14 forward, and partition the space between air guide 18 and isolated parts 19*b* of air guide 19.

As illustrated in FIG. 7, lower end 20*a* of wind direction plate 20 and lower end 21*a* of wind direction plate 21 are in contact with inner surfaces of isolated parts 19*b* of air guide 19. On the other hand, upper end 20*b* of wind direction plate 20 and upper end 21*b* of wind direction plate 21 are in contact with an outer surface of air guide 18.

Wind direction plates 20, 21 are formed such that a length in the front-back direction and a length in a height direction of wind direction plate 20 are larger than a length in the front-back direction and a length in a height direction of wind direction plate 21 as illustrated in FIG. 14A. That is, an area of wind direction plate 20 is larger than an area of wind direction plate 21.

As illustrated in FIG. 7 and FIG. 8, the discharge path that is a space between air guide 18 and isolated parts 19*b* of air guide 19 is partitioned into three spaces (spaces S1, S2, S3 from a downstream side to an upstream side in rotation direction R of circulation fan 14 in order) by wind direction plates 20, 21. Generally, the hot air sent out by circulation fan 14 is collected toward the downstream side in rotation direction R of circulation fan 14, and therefore air volume of the hot air becomes strong.

However, according to this exemplary embodiment, wind direction plate 20 is larger than wind direction plate 21 as described above, and therefore air volume of hot air flowing in space S3 partitioned by wind direction plate 20 can be increased in a space between air guide 18 and air guide 19. Such wind direction plates 20, 21 having different sizes partition the discharge path into spaces S1 to S3, so that it is possible to more uniformly an air volume distribution of hot air D1 to D3 (refer to FIG. 8) flowing in spaces S1 to S3.

Now, details of a circulation flow in cavity 2 generated by supply and exhaust of hot air generation mechanism 36 described above is described with reference to FIG. 15.

Figure 15:
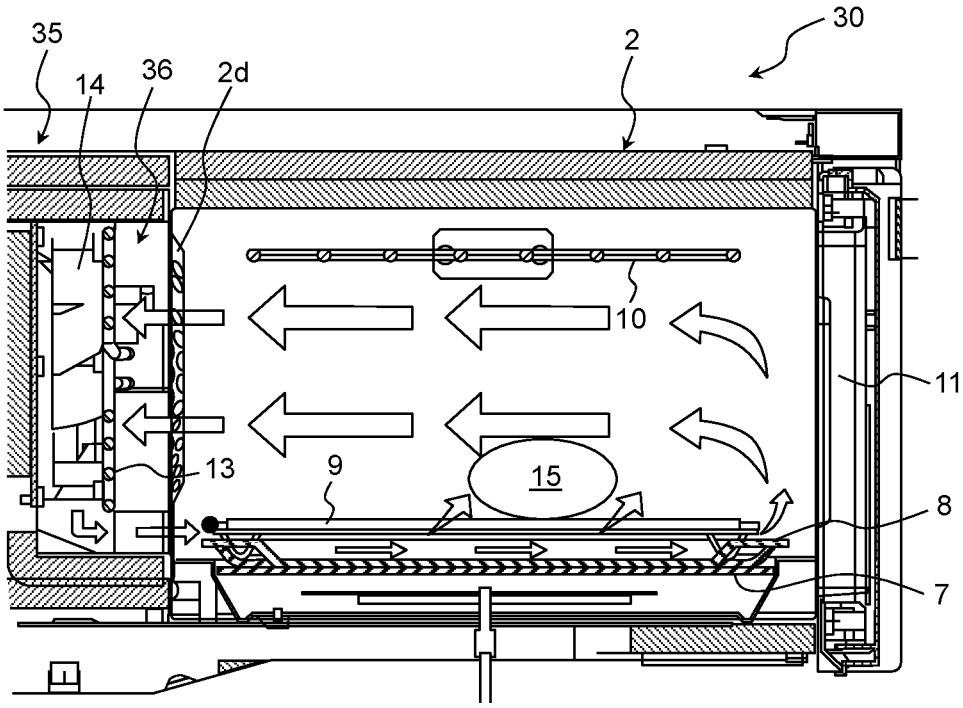
FIG. 15 is a diagram illustrating a circulation flow of an inside of the cavity according to the first exemplary embodiment.

As illustrated in FIG. 15, hot air discharged from convection device 35 flows toward wire rack 9 and tray 8. Wire rack 9 on which object 15 to be heated is placed has a structure in which air is capable of passing between a lower side and an upper side, namely has a so-called air permeable structure, and therefore hot air is capable of passing below object 15 to be heated.

The hot air passing below object 15 to be heated moves forward while moving also upward. Thereafter, the hot air that has moved forward hits on door 11 to move along door 11 upward. Thereafter, the hot air flows backward so as to pass on object 15 to be heated by suction force of circulation fan 14. Finally, the hot air is sucked into convection device 35 through suction ports 22*a*.

A whole surface of object 15 to be heated can be heated by such a hot air circulation flow, and more uniform heating can be performed. Particularly, the hot air is supplied below object 15 to be heated, and therefore it is possible to efficiently heat an undersurface of object 15 to be heated, which is generally unlikely heated, and it is possible to more uniformly heat object 15 to be heated.

Figure 16:
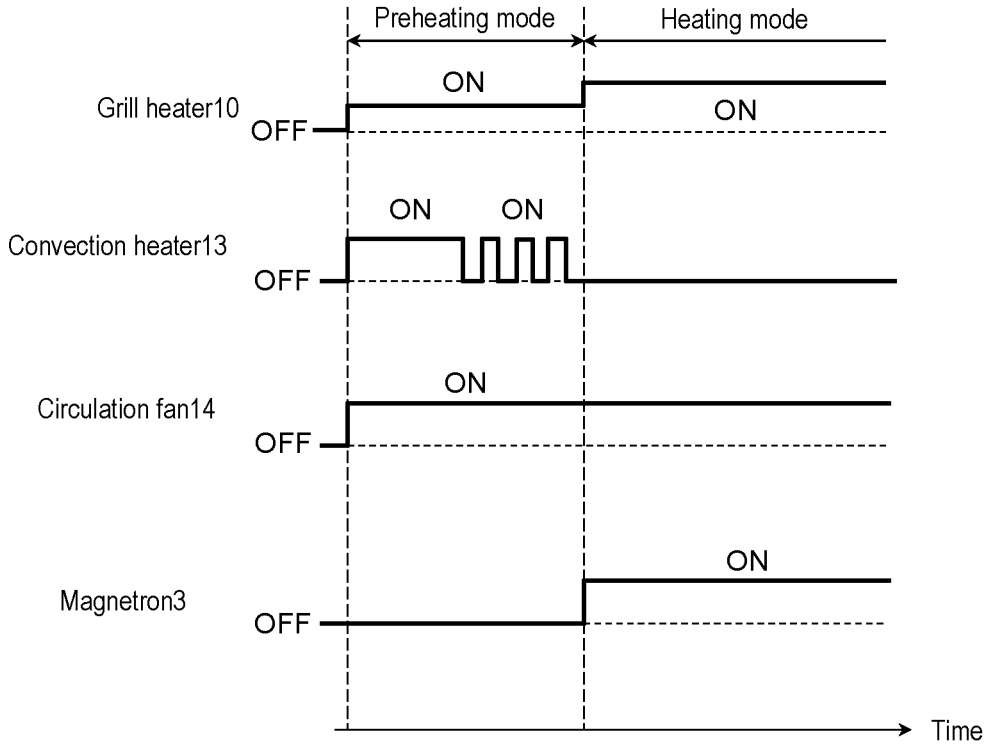
FIG. 16 is a timing chart according to an example of heating operation of the heating cooker according to the first exemplary embodiment.

Now, an example of heating operation by heating cooker 30 is described with reference to FIG. 16. FIG. 16 is a timing chart illustrating ON/OFF of grill heater 10, convection heater 13, circulation fan 14, and microwave generator 3. In the example illustrated in FIG. 16, after a preheating mode is performed, a heating mode is performed, so that object 15 to be heated is heated.

The preheating mode is a mode in which the inside of cavity 2 is previously heated before the heating mode in a state where object 15 to be heated is not disposed inside cavity 2.

In control in the preheating mode, grill heater 10 is kept in an ON state, and convection heater 13 is first kept in an ON state for a while, and thereafter the ON state and the OFF state are repeated, circulation fan 14 is kept in an ON state, and microwave generator 3 is kept in an OFF state. By such control, while grill heater 10 heats the whole inside of cavity 2 by radiation, convection heater 13 and circulation fan 14 generate a circulation flow inside cavity 2. Thus, before the heating mode is started, the whole inside of cavity 2 is uniformly heated up to a predetermined temperature (for example, 230° C.).

A temperature of the inside of cavity 2 is continuously measured by a temperature sensor (not illustrated). When the temperature of the inside of cavity 2 reaches a predetermined preheating setting temperature (for example, 230° C.), convection heater 13 is switched from the ON state into ON/OFF control. A reason why the ON/OFF control is performed for convection heater 13 is that the temperature of the inside of cavity 2 is kept at a substantially preheating setting temperature.

Circulation fan 14 is rotated at a low speed (for example, 2000 rpm), so that the temperature of the inside of cavity 2 makes uniform, and it is possible to prolong life of a motor of circulation fan 14.

Now, the heating mode is described. The heating mode is a mode in which object 15 to be heated is heated by a microwave and the like in a state where object 15 to be heated is disposed in cavity 2 heated in the preheating mode.

In control in the heating mode, output of grill heater 10 is increased, convection heater 13 is turned OFF, and circulation fan 14 is continuously kept in the ON state, so that microwave generator 3 is turned on.

Consequently, while object 15 to be heated and the whole inside of cavity 2 are heated by radiation by grill heater 10, a circulation flow is generated in cavity 2 by circulation fan 14. Thus, object 15 to be heated is uniformly heated by combination of radiation heating and convection heating by the circulation flow of hot air.

At the same time, microwave generator 3 is operated, and microwave heating is performed in addition to the radiation heating and the convection heating. The microwave heating using high-output microwave generator 3 is performed, so that it is possible to more rapidly and uniformly heat object 15 to be heated.

In the heating mode, in order to rapidly heat object 15 to be heated, output of grill heater 10 is set in response to the temperature of the inside of cavity 2. For example, in a case where the temperature of the inside of cavity 2 is 230° C., the output of grill heater 10 is set to 350 W. Additionally, in a case where the temperature of the inside of cavity 2 is 150° C., the output of grill heater 10 is set to 260 W.

A reason why convection heater 13 is turned off is that power consumption of whole heating cooker 30 is restricted in a constant range. For example, there is a restriction that an upper limit of a current of a general plug is 20 A. Therefore, in the heating mode using microwave generator 3, convection heater 13 is turned off, thereby enabling a current not to exceed the above upper limit of a current.

Also in this case, grill heater 10 and circulation fan 14 are kept in the ON states, and therefore the radiation heating and the convection heating are continuously performed.

A number of rotations of circulation fan 14 in the heating mode is the same as a number of rotations of circulation fan 14 in the preheating mode in FIG. 16, but is not limited to this, and can be freely set in a range from about 1500 rpm to about 5000 rpm for a purpose of controlling a grilled condition of object 15 to be heated.

As described above, according to the method for heating by combination of the preheating mode and the heating mode, microwave generator 3 having a total output of about 1300 W is used, so that, for example, four sheets of semi-cooked chicken in a frozen state (about 100 g to about 150 g) as object 15 to be heated can be thawed for about four minutes to be heated.

As described above, according to this exemplary embodiment, in convection device 35, hot air is guided to discharge ports 22*b* by air guide 19, so that the hot air is easily concentrated and supplied to a lower part of cavity 2. As a result, it is possible to more rapidly and uniformly heat object 15 to be heated.

Now, a structure of a cooling mechanism for microwave generator 3 and fan drive unit 16 in body 1, which is performed at the same time as the above heating operation, and location of the two magnetron of microwave generator 3 are described with reference to FIG. 17 to FIG. 24.

Figure 17:
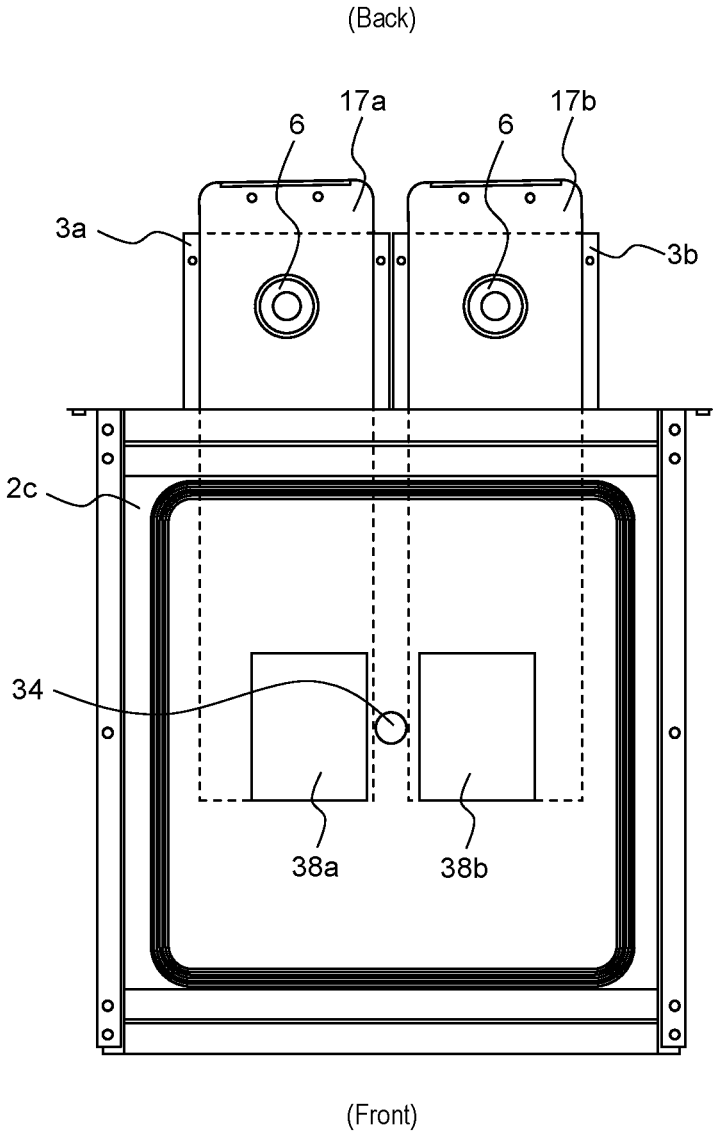
FIG. 17 is a plan view of location of magnetrons and waveguides according to the first exemplary embodiment.

FIG. 17 is a plan view as bottom surface 2*c* of cavity 2 is viewed from an upper side, in order to illustrate location of the two magnetrons (magnetrons 3*a*, 3*b*) and the two waveguides (waveguides 17*a*, 17*b*) provided below cavity 2.

Figure 18:
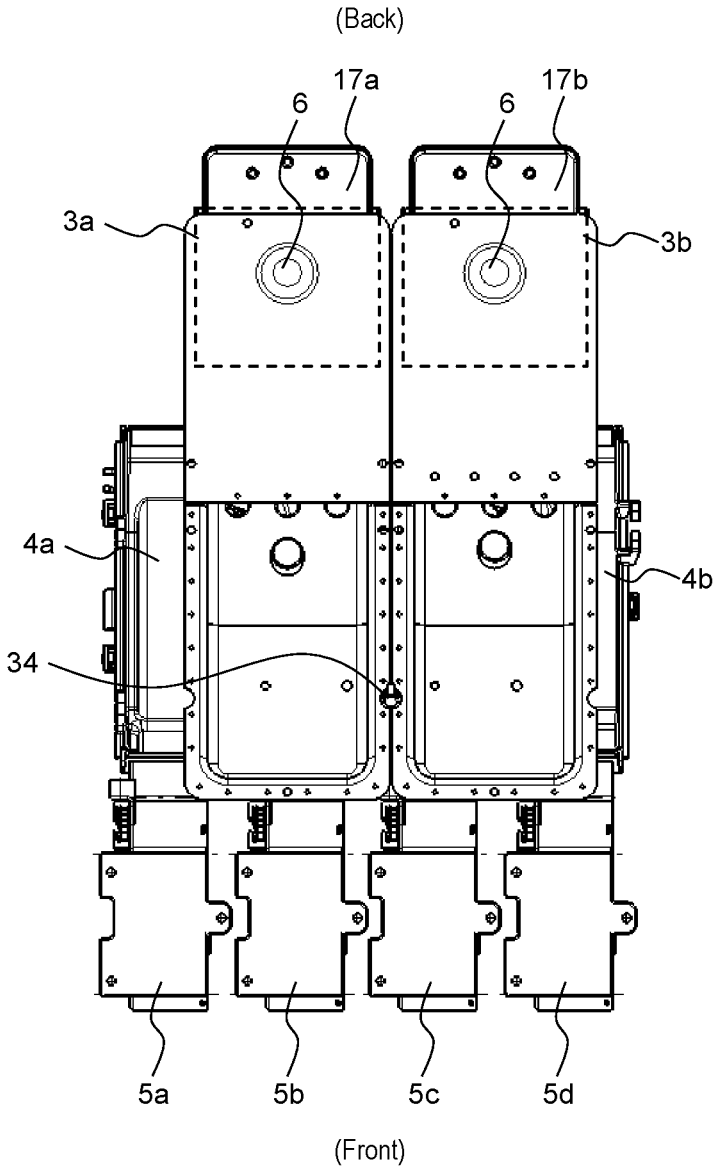
FIG. 18 is a plan view illustrating location of the magnetrons, inverters, the waveguides, and cooling fans according to the first exemplary embodiment.
Figure 19:
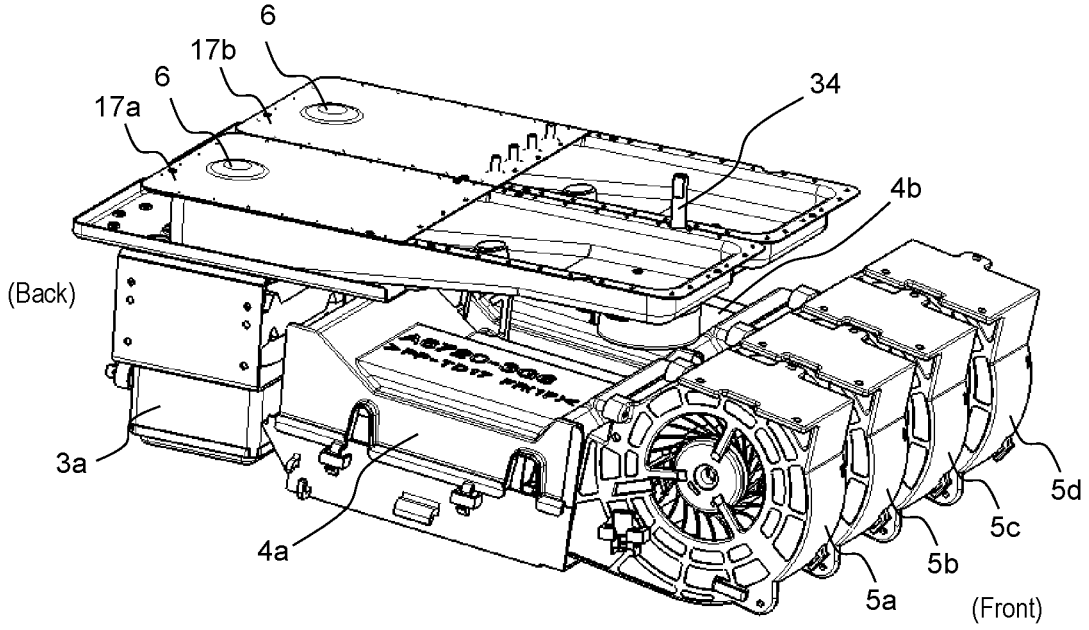
FIG. 19 is a perspective view illustrating location of the magnetrons, the inverters, the waveguides, and the cooling fans according to the first exemplary embodiment.

FIG. 18 and FIG. 19 are, respectively, a plan view and a perspective view for illustrating location of the two magnetrons, the two inverters (inverters 4*a*, 4*b*), the two waveguides, and the four cooling fans (cooling fans 5*a* to 5*d*) in machine chamber 31.

Magnetrons 3*a*, 3*b* are disposed side by side in a right-left direction respectively. Waveguide 17*a* and waveguide 17*b* extending from magnetrons 3*a*, 3*b* respectively are also disposed side by side in a right-left direction respectively. Waveguides 17*a*, 17*b* extend forward from magnetrons 3*a*, 3*b*, respectively.

Microwave radiation hole 38*a* and microwave radiation hole 38*b* formed in leading ends of waveguides 17*a*, 17*b* are points for supplying microwaves into cavity 2, which are connected to openings in bottom surface 2*c* of cavity 2. Stirrer shaft 34 penetrates bottom surface 2*c* of cavity 2 between microwave radiation holes 38*a*, 38*b*.

As illustrated in FIG. 18 and FIG. 19, in this exemplary embodiment, inverters 4*a*, 4*b* are provided for magnetrons 3*a*, 3*b*, respectively, and magnetrons 3*a*, 3*b* are separately driven by inverters 4*a*, 4*b*, respectively.

Cooling fan 5*a* and cooling fan 5*b* are provided in order to cool magnetron 3*a* and inverter 4*a*, respectively, and cooling fan 5*c* and cooling fan 5*d* are provided in order to cool magnetron 3*b* and inverter 4*b*, respectively.

Cooling fans 5*a* to 5*d* are configured by multiblade fans and the like, are installed in front of inverters 4*a*, 4*b* such that respective rotating shafts are aligned on a straight line, take air from axial directions of the rotating shafts of the fans, and send the air toward a back side of heating cooker 30. In order that the intake of the air in each cooling fan is not hindered by an adjacent cooling fan, cooling fans 5*a* to 5*d* are disposed at predetermined intervals.

Magnetrons 3*a*, 3*b* correspond to first and second microwave generators, respectively. Waveguides 17*a*, 17*b* correspond to first and second waveguides, respectively. Inverters 4*a*, 4*b* correspond to first and second inverters, respectively.

Figure 20:
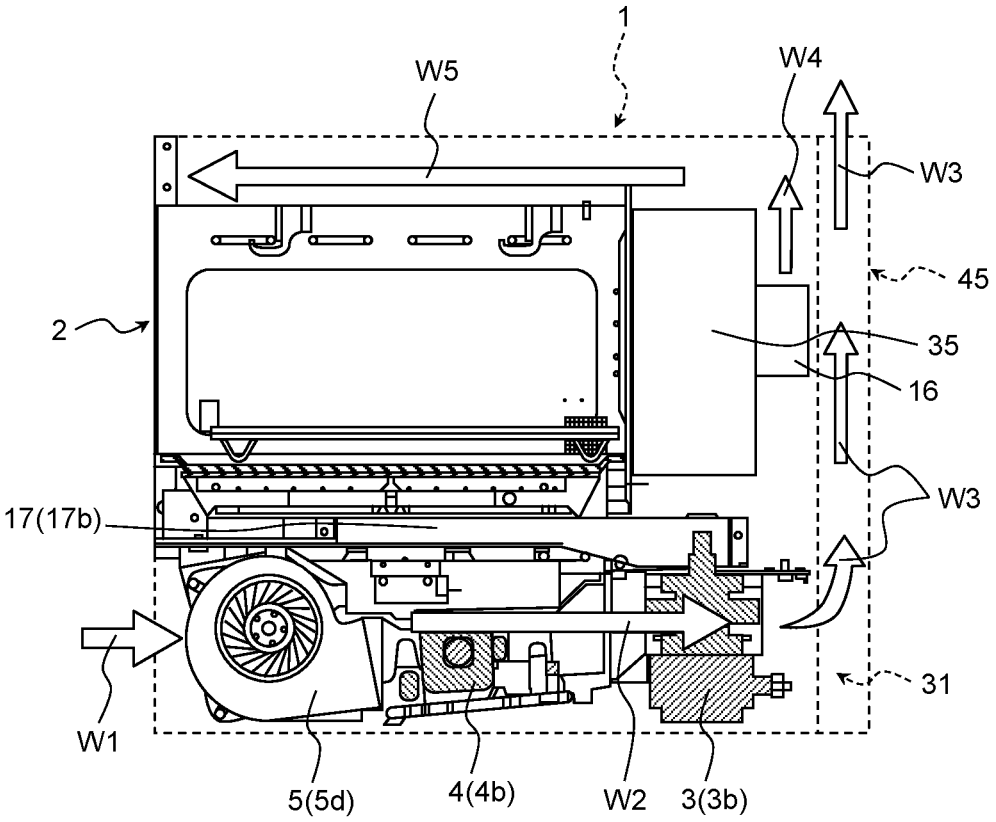
FIG. 20 is a diagram illustrating a flow of cooling air by a cooling mechanism for the magnetrons and a fan drive unit according to the first exemplary embodiment.
Figure 21:
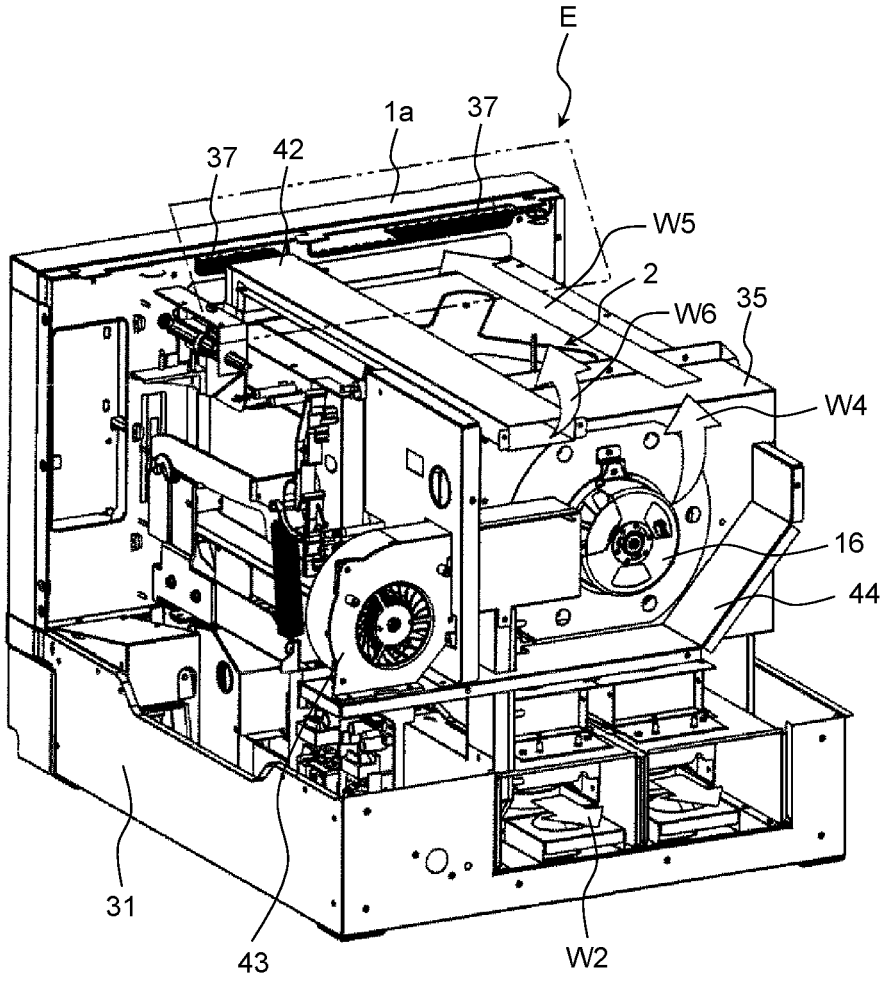
FIG. 21 is a diagram illustrating a flow of cooling air by the cooling mechanism for the magnetrons and the fan drive unit according to the first exemplary embodiment.
Figure 22:
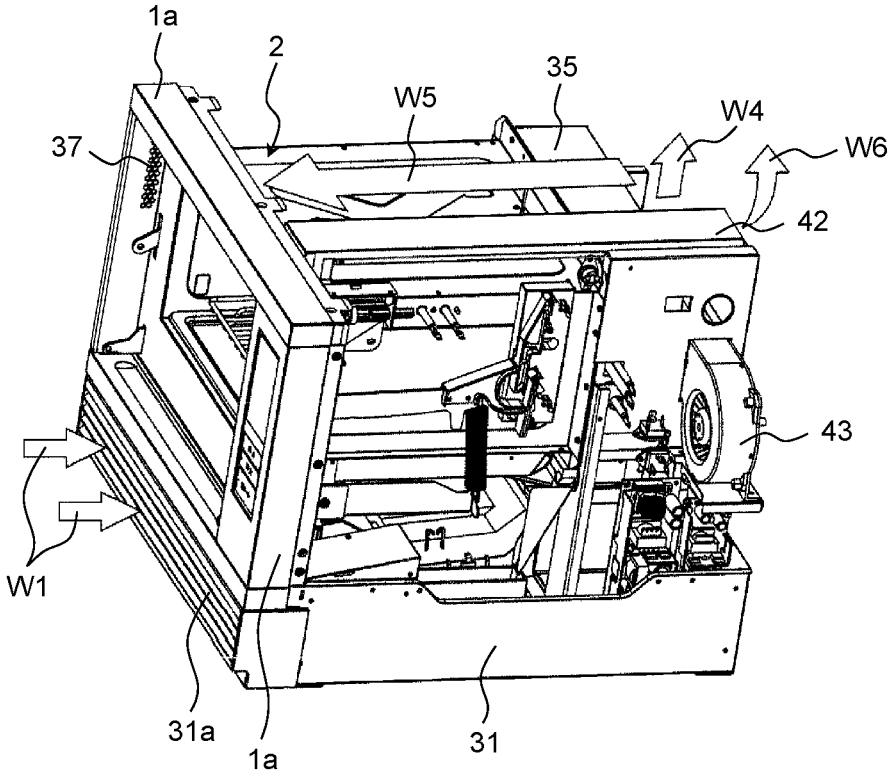
FIG. 22 is a diagram illustrating a flow of cooling air by the cooling mechanism for the magnetrons and the fan drive unit according to the first exemplary embodiment.
Figure 23:
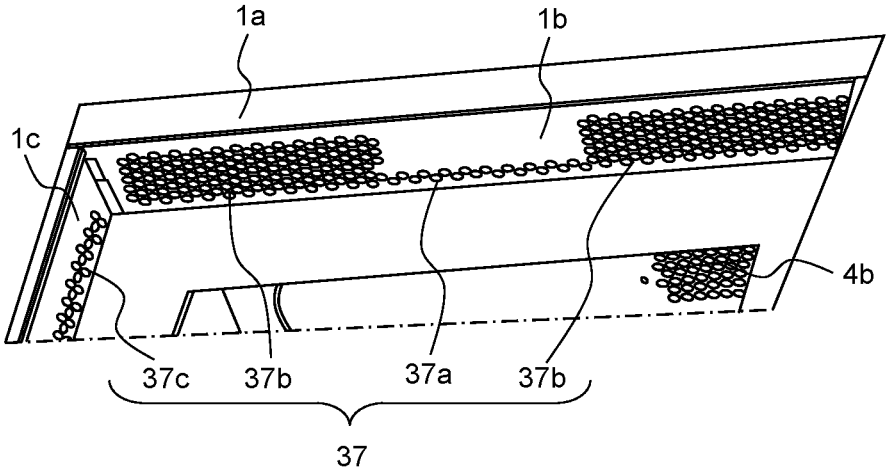
FIG. 23 is an enlarged view of A part of FIG. 4.
Figure 24:
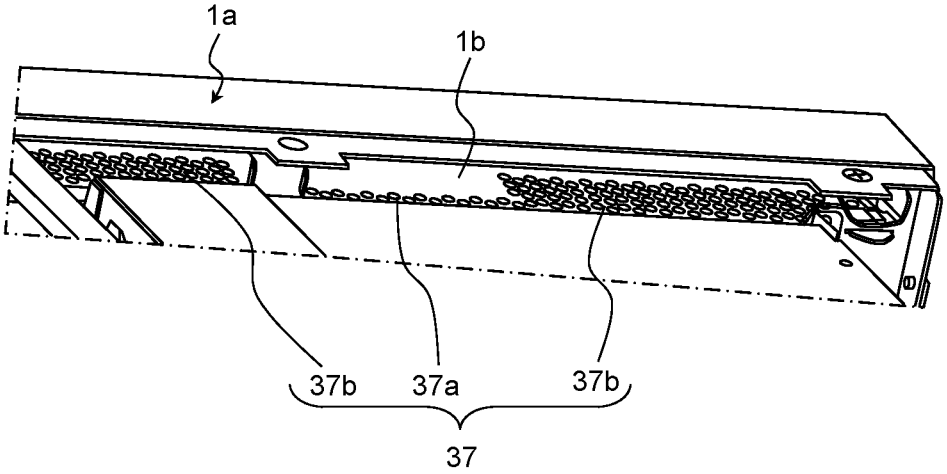
FIG. 24 is an enlarged view of E part of FIG. 21.

FIG. 20 to FIG. 22 each are a diagram for explaining the cooling mechanism for microwave generator 3 and fan drive unit 16, and these diagrams each illustrate a flow of cooling air by the cooling mechanism. FIG. 20 to FIG. 22 each illustrate exposed cavity 2 while components other than front surface 1*a* of body 1 are omitted for explanation. FIG. 23 is an enlarged view of A part of FIG. 4, and FIG. 24 is an enlarged view of E part of FIG. 21.

As illustrated in FIG. 20 to FIG. 22, when cooling unit 5 is operated, air is sucked from front grill 31*a* of machine chamber 31 (refer to arrow W1), and the air is sent out toward a back side of cooling unit 5 (refer to arrow W2). The air sent out cools inverter unit 4 and microwave generator 3 in order.

The air that cools inverter unit 4 and microwave generator 3 passes through exhaust duct 45 (refer to FIG. 5A) disposed on a rear surface of body 1 and is then discharged above heating cooker 30 (refer to arrow W3). In FIG. 21 and FIG. 22, illustration of exhaust duct 45 is omitted.

On the other hand, when cooling fan 43 for fan drive unit 16 is operated, a space in body 1 located behind operation part 41 is sent out toward fan drive unit 16. The air sent out is guided upward by partition part 44 (refer to FIG. 21) (arrow W4). The air guided upward hits on an upper surface of body 1, and flows through a space between body 1 and cavity 2 forward (refer to arrow W5).

Thereafter, exhaust holes 37 formed in inner upper surface 1*b* and inner side surface 1*c* (refer to FIG. 23 and FIG. 24) of front surface 1*a* of body 1 is exhausted outside heating cooker 30. Exhaust holes 37 are disposed so as to face an upper surface and a side surface of door 11 being closed.

According to the above cooling mechanism, inverter unit 4 and microwave generator 3 are cooled by use of cooling unit 5, and fan drive unit 16 is cooled by use of cooling fan 43. Thus, inverter unit 4 and microwave generator 3, and fan drive unit 16 are cooled by separate cooling flows, so that it is possible to attain efficient cooling.

Generally, when heating operation is performed, a temperature of microwave generator 3 becomes higher than a temperature of inverter unit 4. According to this exemplary embodiment, like the above cooling mechanism, inverter unit 4 and microwave generator 3 are cooled in order of a low temperature, so that it is possible to efficiently cool inverter unit 4 and microwave generator 3.

Cooling air constantly flows through an inner space of body 1 by cooling fan 43, and therefore an effect of reducing a surface temperature of an upper surface and a front surface of heating cooker 30 (an upper surface and front surface 1*a* of body 1) is also exerted.

Additionally, the air that cools fan drive unit 16 to be exhausted from exhaust holes 37 hits on the upper surface and the side surface of door 11. Consequently, unlike a case where exhaust holes 37 is formed in, for example, front surface 1*a* of body 1, air discharged from exhaust holes 37 is unlikely to directly hit on a user, and therefore it is possible to reduce uncomfortable feeling of the user.

As illustrated in FIG. 23 and FIG. 24, in exhaust holes 37 formed in inner upper surface 1*b* of body 1, a number of exhaust holes 37*a* disposed at a central part is less than a number of exhaust holes 37*b* disposed right and left of the central part. Thus, exhaust volume from the central part is decreased.

Consequently, when the user grips handle 12 provided on central upper side of door 11, it is possible to reduce the volume of exhaust received from exhaust holes 37, and it is possible to reduce the uncomfortable feeling of the user. Exhaust holes 37*c* is also provided in inner side surface 1*c* in addition to exhaust holes 37*a*, 37*b*, and hot air to be exhausted is dispersed, so that it is possible to further reduce the uncomfortable feeling of the user.

Front grill 31*a* is provided on a front surface of heating cooker 30, and therefore it is possible to reliably suck air regardless of whether other object exists adjacent to right and left. Consequently, for example, even in a case where a plurality of heating cookers 30 are disposed right and left adjacent to each other, it is possible to ensure a suction path of cooling air.

In this exemplary embodiment, as illustrated in FIG. 20, microwave generator 3 (magnetrons 3*a*, 3*b*) are disposed below convection device 35, cooling unit 5 (cooling fans 5*a* to 5*d*) and inverter unit 4 (inverters 4*a*, 4*b*) are disposed below cavity 2.

As illustrated in FIG. 17 to FIG. 19, a group of magnetron 3*a* and waveguide 17*a*, and a group of magnetron 3*b* and waveguide 17*b* are disposed right and left, respectively, and waveguides 17*a*, 17*b* are disposed so as to extend in the front-back direction.

Inverter 4*a* is disposed below waveguide 17*a* so as to be aligned with magnetron 3*a* in the front-back direction. Inverter 4*b* is disposed below waveguide 17*b* so as to be aligned with magnetron 3*b* in the front-back direction. Cooling fans 5*a* to 5*d* are disposed so as to be aligned with inverters 4*a*, 4*b* in the front-back direction and are disposed such that the respective rotating shafts of the fans are aligned on a straight line.

With the above configuration, it is possible to effectively utilize a space inside machine chamber 31. As a result, a lateral dimension of heating cooker 30 including a plurality of magnetrons can be designed much smaller. In a convenience store, a fast food restaurant, and the like, a plurality of heating cookers are often installed adjacent to each other in a right-left direction. This effect is particularly meaningful for a microwave oven for business use.

Steam and the like inside cavity 2, generated during the heating operation pass through exhaust duct 42, and are exhausted upward from the back part of body 1 (arrow W6), as illustrated in FIG. 21 and FIG. 22.

Now, a structure of hinges supporting opening/closing of door 11 is described with reference to FIG. 25 to FIG. 29.

Figure 25:
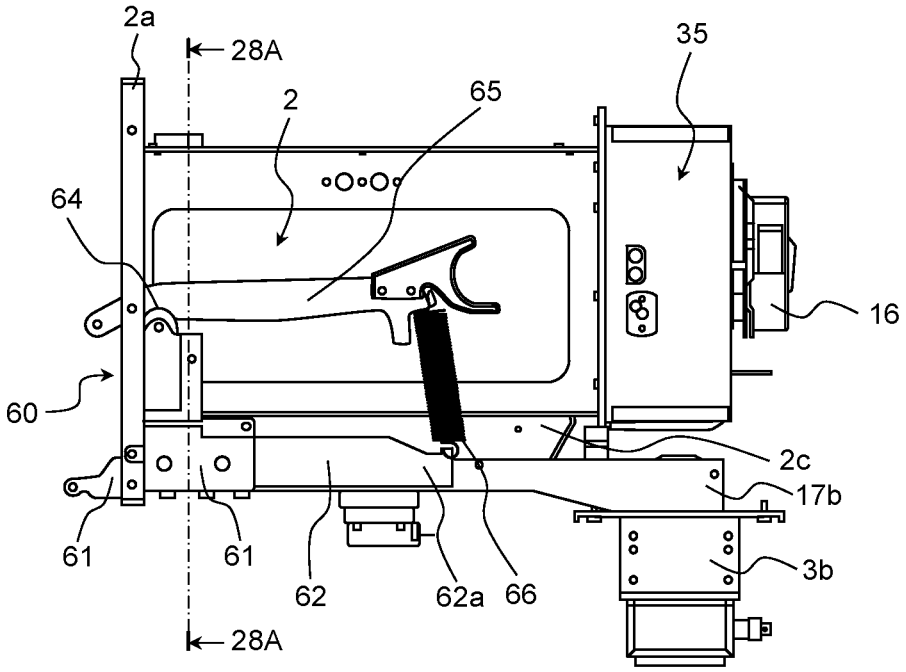
FIG. 25 is a side view of a hinge structure according to the first exemplary embodiment.
Figure 26:
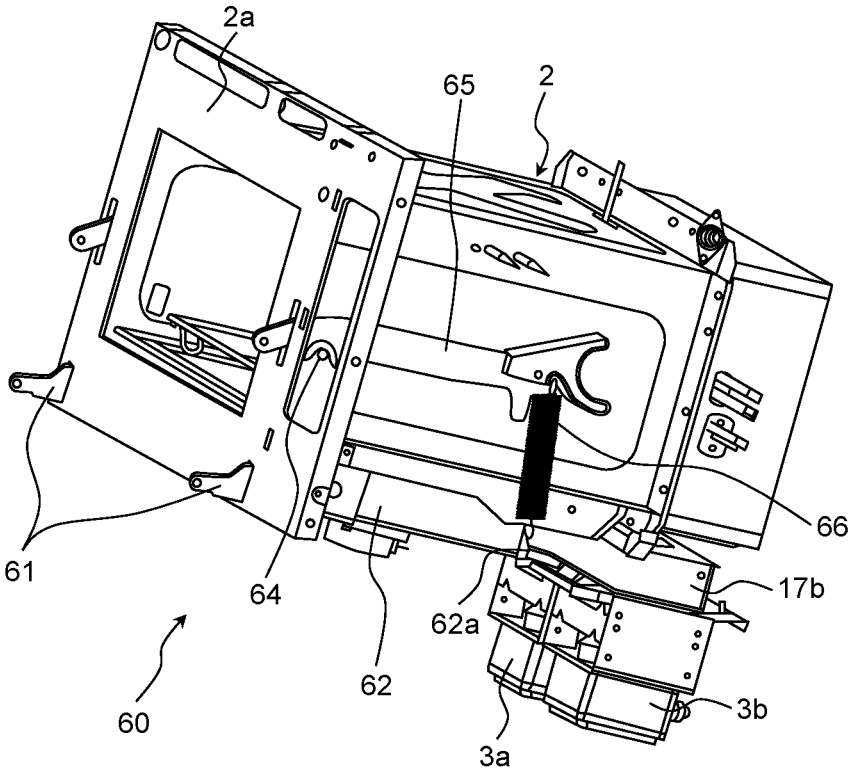
FIG. 26 is a perspective view of the hinge structure according to the first exemplary embodiment.
Figure 27A:
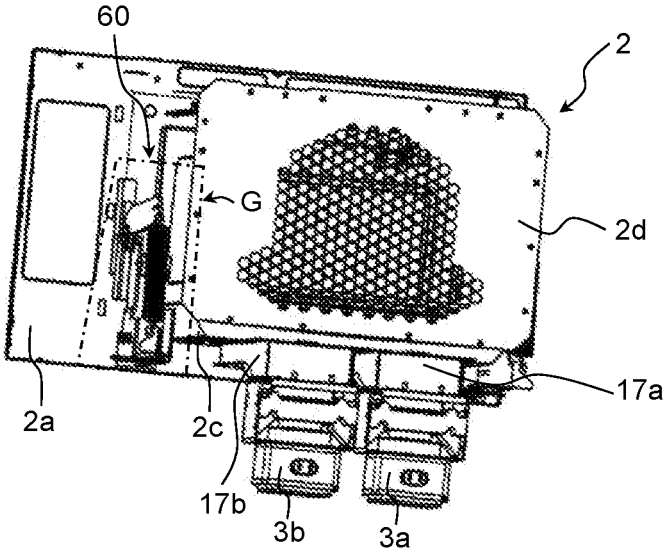
FIG. 27A is a perspective view of the hinge structure according to the first exemplary embodiment.
Figure 27B:
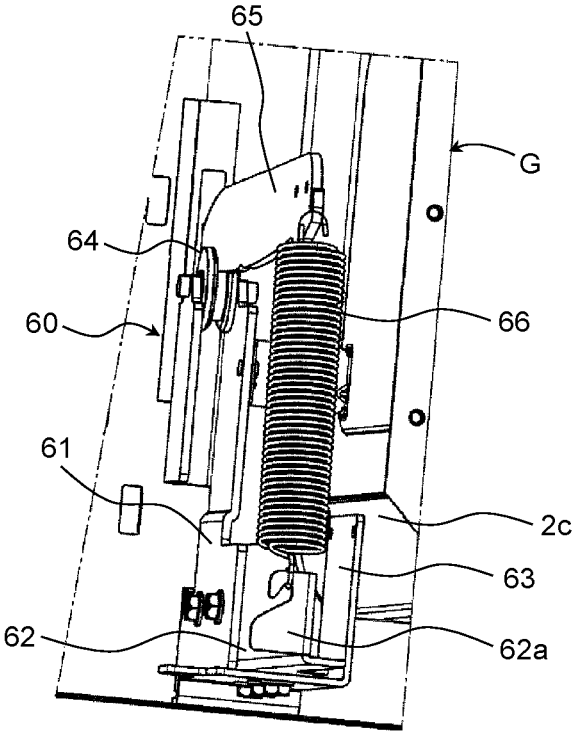
FIG. 27B is an enlarged view of G part of FIG. 27A.
Figure 28A:
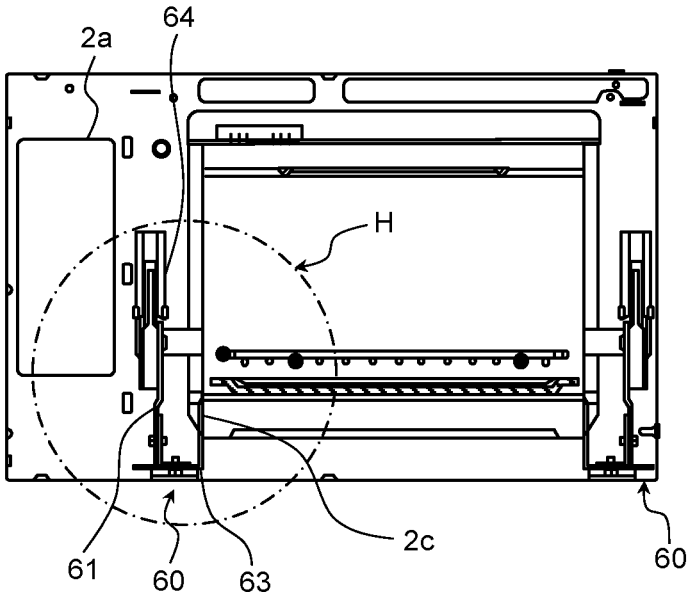
FIG. 28A is a sectional view taken along line 28A-28A of FIG. 25.
Figure 28B:
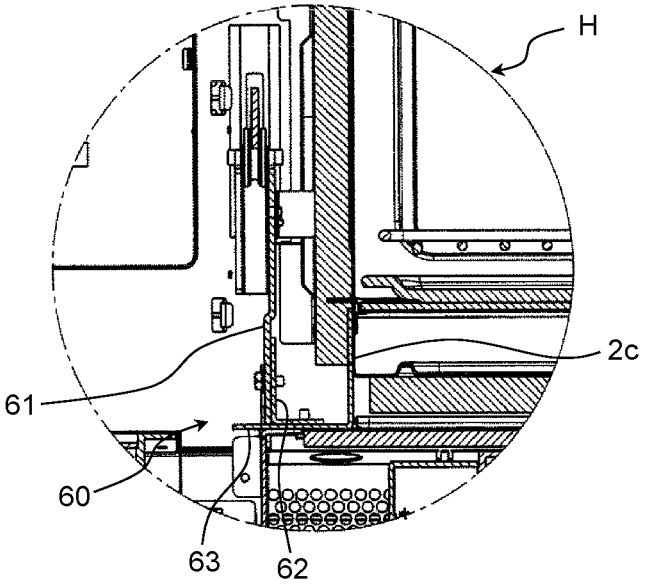
FIG. 28B is an enlarged view of H part of FIG. 28A.
Figure 29:
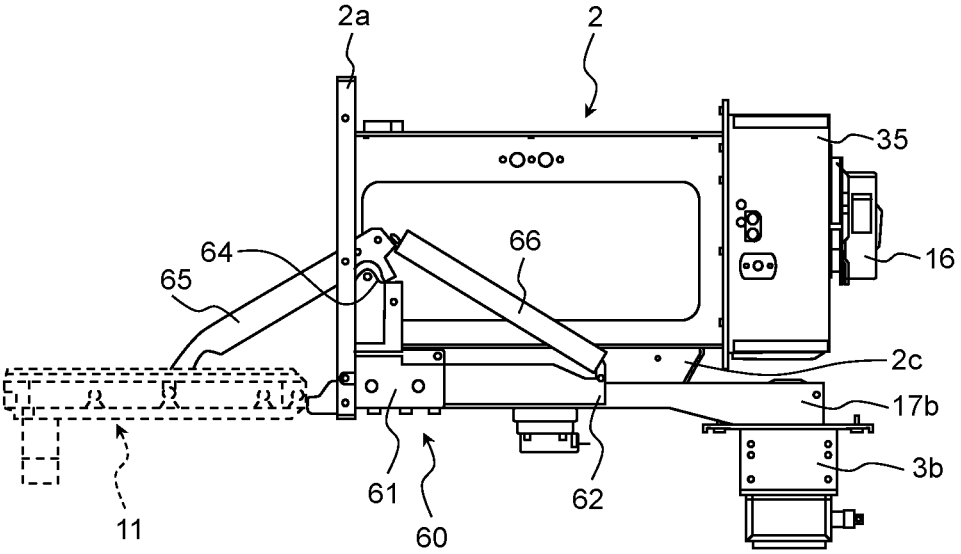
FIG. 29 is a side view of the hinge structure according to the first exemplary embodiment.

FIG. 25 is a side view of the inside of body 1 with door 11 closed (door 11 is not illustrated). FIG. 26 and FIG. 27A each are a perspective view of the inside of body 1 with door 11 closed (door 11 is not illustrated). FIG. 27B is an enlarged view of G part surrounded by one dot chain line in FIG. 27A. FIG. 28A is a sectional view taken along line 28A-28A of FIG. 25. FIG. 28B is an enlarged view of H part surrounded by one dot chain line in FIG. 28A. FIG. 29 is a side view of the inside of body 1 with door 11 opened.

As illustrated in FIG. 25 to FIG. 29, a pair of hinge structures 60 is provided in right and left spaces between a side surface of cavity 2 and a side surface of body 1. Hinge structures 60 each include hinge 61, door hinge spacer 62, hinge mounting plate 63, door guide roller 64, door arm 65, and spring 66.

As illustrated in FIG. 25, FIG. 26, and the like, hinge 61 penetrates front surface 2*a* of cavity 2, is fixed to door hinge spacer 62, and rotatably supports a lower end part of door 11. As illustrated in FIG. 27A, FIG. 27B, and the like, hinge 61, hinge mounting plate 63, and spring 66 are mounted on door hinge spacer 62.

At an end on a back side of door hinge spacer 62, hook 62*a* for hooking spring 66 is provided. Hinge mounting plate 63 is fixed to door hinge spacer 62 and bottom surface 2*c* of cavity 2, and hinge 61 is fixed to bottom surface 2*c* of cavity 2 through door hinge spacer 62.

Door guide roller 64 supports sliding in the front-back direction of door arm 65. Door arm 65 has a first end mounted on a central part of door 11, and a second end mounted on a first end of spring 66, and supports opening/closing of door 11 along with hinge 61. A second end of spring 66 is fixed to hook 62*a* of door hinge spacer 62. When door 11 is closed, spring 66 contracts (refer to FIG. 25). When door 11 is opened, spring 66 extends (refer to FIG. 29).

In the above configuration, door 11 shifts from a closed state to an opened state (refer to FIG. 25 to FIG. 29) by rotating around the lower end part, which is a connection point with hinges 61, in a longitudinal direction. At this time, door arms 65 connected to the central part of door 11 move forward while sliding on door guide rollers 64. Springs 66 mounted on the second ends of door arm 65 are brought into an elongated state from a contracted state by the movement of door arms 65.

By such operation of hinge structures 60, door 11 is opened. On the contrary, when door 11 shifts from the opened state to the closed state (refer to FIG. 29 to FIG. 25), reverse operation to the above operation is performed.

In this exemplary embodiment, hinge structures 60 including hinges 61 are mounted on bottom surface 2*c* of cavity 2 by hinge mounting plates 63. Unlike this, in a case of a configuration in which hinges 61 are mounted not on cavity 2 but on body 1, a difference between a temperature of hinges 61 and a temperature of front surface 2*a* of cavity 2 is increased. Therefore, when door 11 is closed, a gap between door 11 mounted on hinges 61 and front surface 2*a* of cavity 2 may be generated by a difference in a coefficient of thermal expansion.

Compared to such a configuration, according to hinge structures 60 of this exemplary embodiment, hinges 61 are mounted on bottom surface 2*c* of cavity 2, and therefore a temperature difference between hinge 61 and front surface 2*a* of cavity 2 is reduced. Consequently, it is possible to reduce a possibility that a gap is generated between door 11 and front surface 2*a* of cavity 2 when door 11 is closed.

Thus, the present disclosure is described while the above exemplary embodiment is given, but the present disclosure is not limited to the above exemplary embodiment. In this exemplary embodiment, waveguides 17*a*, 17*b* linearly extend forward from magnetrons 3*a*, 3*b*.

Figure 30:
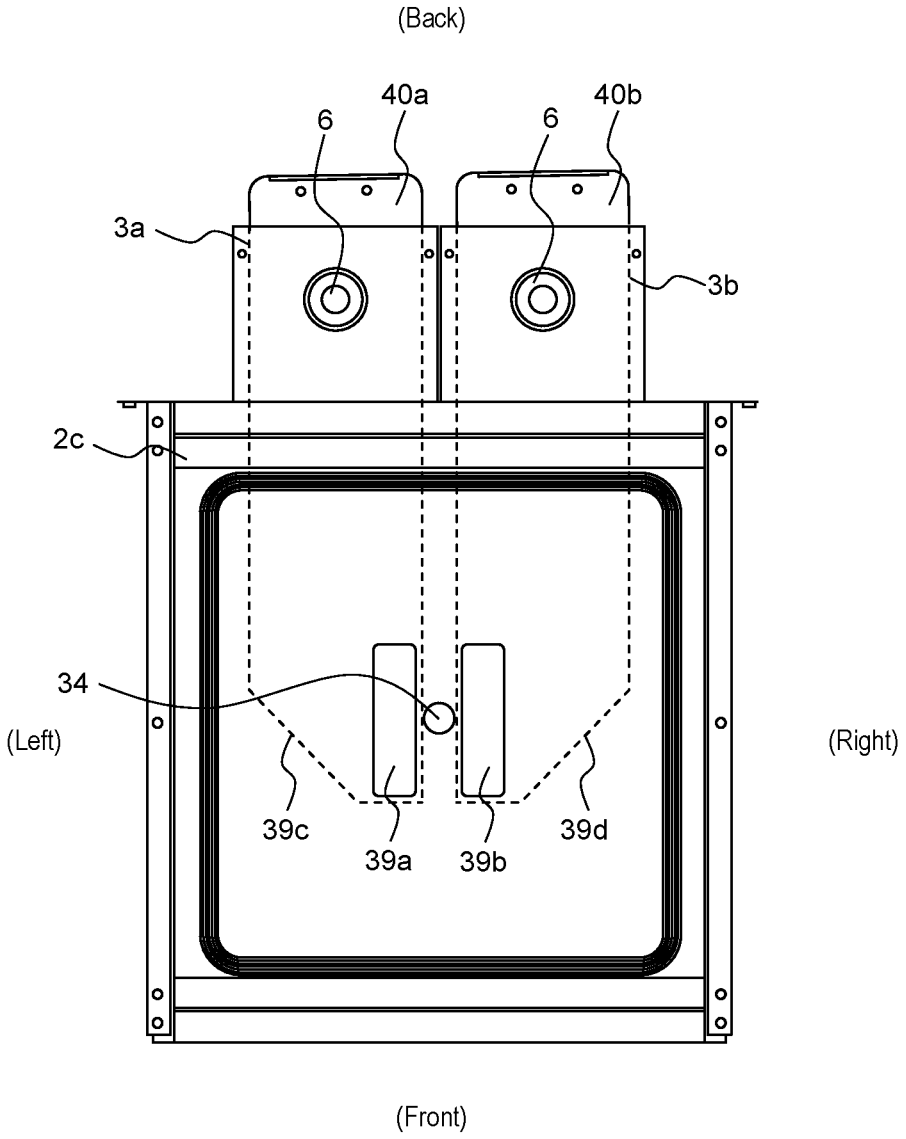
FIG. 30 is a plan view illustrating location of magnetrons, inverters, and waveguides of a heating cooker according to a modification of the first exemplary embodiment.

However, for example, as illustrated in FIG. 30, waveguides 40*a* and waveguides 40*b* may have H corner shape 39*c* and H corner shape 39*d* curved toward microwave radiation hole 39*a* and microwave radiation hole 39*b* at 90 degrees, respectively.

While an "E corner shape" is a shape in which a waveguide is bent in parallel to an electric field surface (E surface), the "H corner shape" is a shape in which each waveguides 40*a*, 40*b* is bent in parallel to a magnetic field surface (H surface). Waveguides 40*a*, 40*b* are connected to microwave radiation holes 39*a*, 39*b* at H corner shapes 39*c*, 39*d*, so that microwaves whose advancing directions are bent at 90 degrees overlap with each other in a vicinity of a central part of cavity 2; therefore, it is possible to radiate microwaves having higher intensity.

Second Exemplary Embodiment

Figure 31:
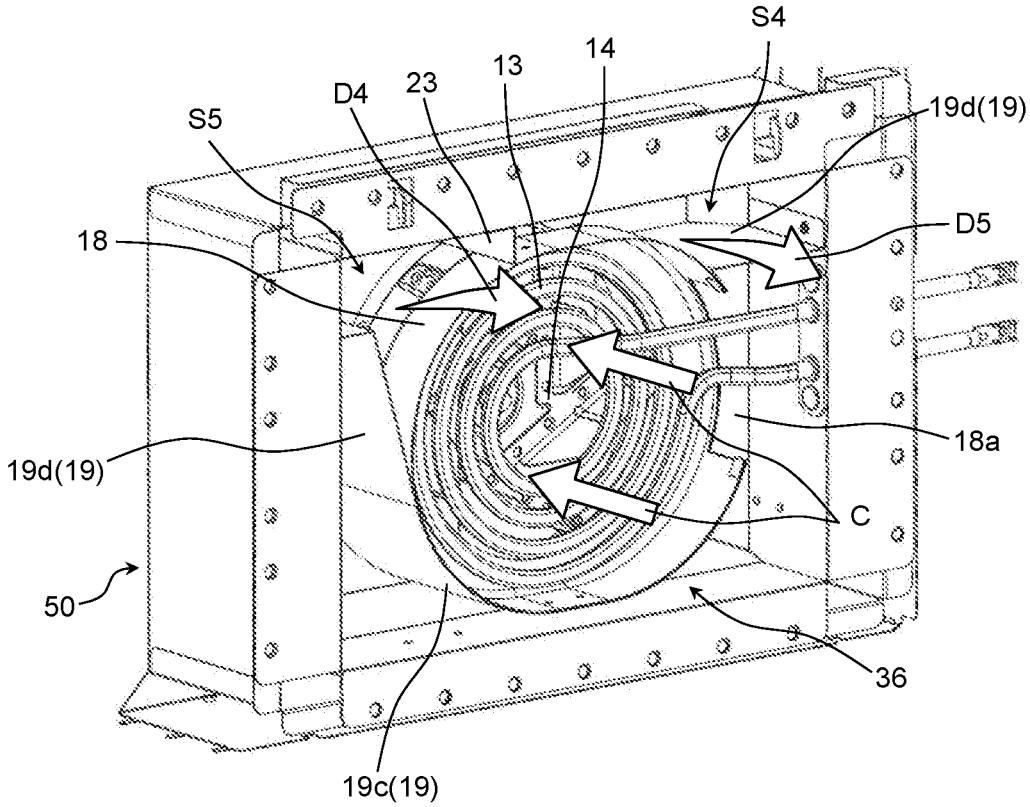
FIG. 31 is a perspective view of a convection device according to a second exemplary embodiment.
Figure 32:
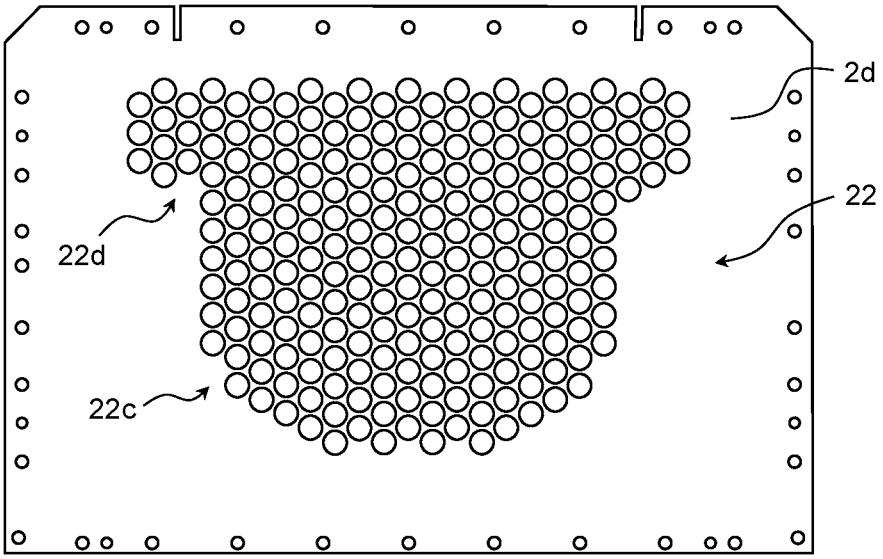
FIG. 32 is a front view of a back wall of a cavity according to the second exemplary embodiment of the present disclosure.

Hereinafter, a heating device according to a second exemplary embodiment of the present disclosure is described with reference to FIG. 31 to FIG. 33. FIG. 31 is a perspective view of convection device 50 according to the second exemplary embodiment. FIG. 32 is a front view of back wall 2*d* of cavity 2 according to the second exemplary embodiment of the present disclosure.

Similarly to the first exemplary embodiment, convection device 50 for generating hot air to be supplied into cavity 2 is provided behind back wall 2*d* of cavity 2 also in this exemplary embodiment. Convection device 50 is partitioned from cavity 2 by back wall 2*d*, and is communicated with cavity 2 through openings 22.

However, as illustrated in FIG. 31, in this exemplary embodiment, upper and lower positional relation of joining part 19*c* and isolated part 19*d* of air guide 19 is reversed to upper and lower positional relation of the joining part and the isolated part in the first exemplary embodiment. That is, isolated part 19*d* of air guide 19 is provided so as to be isolated from air guide 18 in an upper half of air guide 18.

With this configuration, discharge ports 22*d* are provided above suction ports 22*c* formed at a substantially central part of back wall 2*d* (refer to FIG. 32) in this exemplary embodiment.

While air guide 19 is formed by a separate member from air guide 18 in the first exemplary embodiment, joining part 19*c* of air guide 19 is formed integrally with air guide 18 in this exemplary embodiment.

Furthermore, while the two wind direction plates (wind direction plates 20, 21) are provided in the front-back direction between air guide 18 and air guide 19 in the first exemplary embodiment, a single wind direction plate (wind direction plate 23) is provided in the front-back direction between air guide 18 and air guide 19 in this exemplary embodiment.

Wind direction plate 23 partitions a space between air guide 18 and isolated part 19*d* of air guide 19, and directs forward hot air spirally sent out by circulation fan 14, similarly to wind direction plates 20, 21.

In the above configuration, when circulation fan 14 is driven, air in cavity 2 is sucked into convection device 50 through suction ports 22*a* of back wall 2*d* (refer to arrow C of FIG. 31). The sucked air flows toward circulation fan 14 by air guide 18.

The air sent out by circulation fan 14 is guided to air guide 19, and flows through the space formed between air guide 18 and isolated part 19*d* of air guide 19 (arrows D4, D5). Thereafter, the air is sent out to a vicinity of a ceiling of cavity 2 through discharge ports 22*b* of back wall 2*d*.

Figure 33:
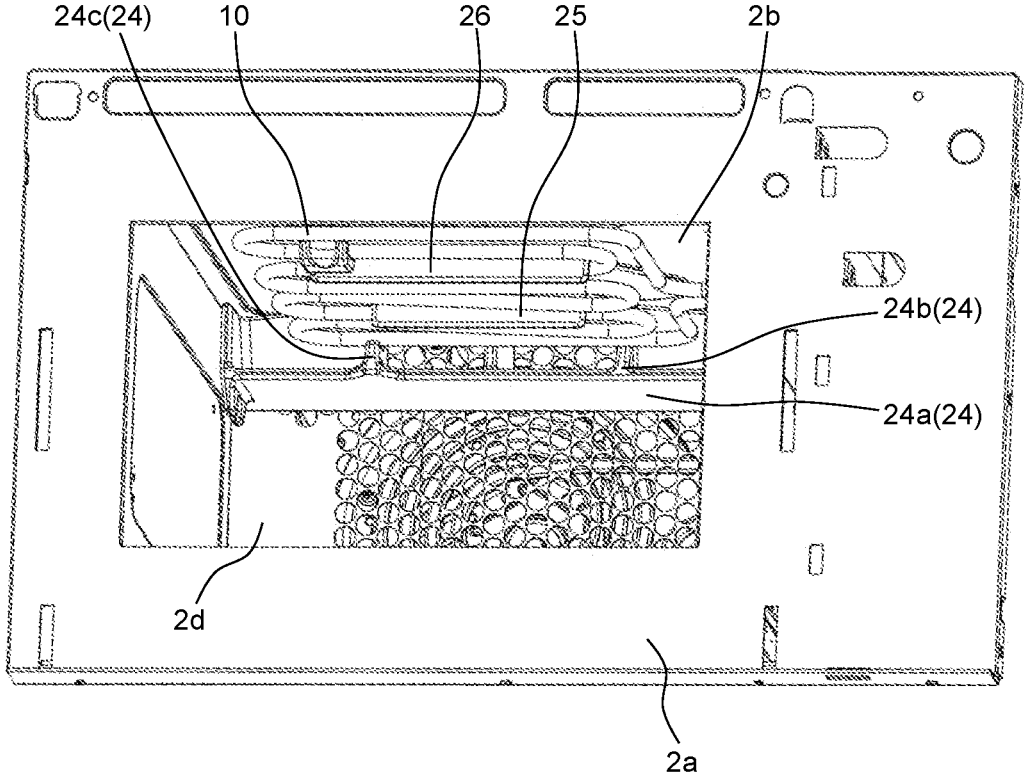
FIG. 33 is a perspective view illustrating an inside of the cavity according to the second exemplary embodiment.

FIG. 33 is a perspective view illustrating an inside of cavity 2, particularly the ceiling according to the second exemplary embodiment. As illustrated in FIG. 33, in this exemplary embodiment, wind direction plate 24 protruding forward is provided in a vicinity of a borderline between suction ports 22*c* and discharge ports 22*d* of back wall 2*d*. Wind direction plate 24 has horizontal portion 24*a* horizontally extending across cavity 2 in a right-left direction, and vertical portion 24*b* and vertical portion 24*c* formed above horizontal portion 24*a*, and vertically extending at a predetermined interval.

Wind direction plate 24 imparts directivity to a flow of air supplied from convection device 35 into cavity 2, and directs most of the flow of the air toward grill heater 10.

Two wind direction plates (wind direction plates 25, 26) extending in a right-left direction are provided on ceiling 2*b* of cavity 2 so as to be located in a vicinity of grill heater 10 (more specifically, surrounded by bent grill heater 10). A width of wind direction plate 26 is wider than a width of wind direction plate 25 located behind wind direction plate 26.

Wind direction plates 25, 26 direct a portion of the flow of the air sent out from convection device 35 downward, in a vicinity of a center of the ceiling of cavity 2.

With the above configuration, a portion of a circulation flow of the hot air sent out by convection device 35, and heated by convection heater 13 and/or grill heater 10 is sprayed on object 15 to be heated from above, and heats object 15 to be heated. Thus, it is possible to heat more rapidly and uniformly object 15 to be heated.

INDUSTRIAL APPLICABILITY

The present disclosure is applicable to a microwave oven having a grill mode and a convection mode, and particularly useful for a microwave oven for business use used in a convenience store, a fast food restaurant, or the like.

REFERENCE MARKS IN THE DRAWINGS

1 body
1*a*, 2*a* front surface

2 cavity
2*b* ceiling
2*c* bottom surface
2*d* back wall
3 microwave generator
3*a*, 3*b* magnetron
4 inverter unit
4*a*, 4*b* inverter
5 cooling unit
5*a*, 5*b*, 5*c*, 5*d*, 43 cooling fan
6 antenna
7 plate receiving base
8 tray
9 wire rack
10 grill heater
11 door
12 handle
13 convection heater
14 circulation fan
15 object to be heated
16 fan drive unit
17 waveguide part
17*a*, 17*b*, 40*a*, 40*b* waveguide
18, 19 air guide
18*a* cutaway part
19*a*, 19*c* joining part
19*b*, 19*d* isolated part
20, 21, 23, 24, 25, 26 wind direction plate
20*a*, 21*a* lower end
20*b*, 21*b* upper end
22 opening
22*a*, 22*c* suction port
22*b*, 22*d* discharge port
24*a* horizontal portion
24*b*, 24*c* vertical portion
30 heating cooker
31 machine chamber
31*a* front grill
32 stirrer
33 motor
34 stirrer shaft
35, 50 convection device
36 hot air generation mechanism
37, 37*a*, 37*b*, 37*c* exhaust hole
38*a*, 38*b*, 39*a*, 39*b* microwave radiation hole
39*c*, 39*d* H corner shape
41 operation part
42 exhaust duct
44 partition part
45 exhaust duct
46 exhaust hole
60 hinge structure
61 hinge
62 door hinge spacer
62*a* hook
63 hinge mounting plate
64 door guide roller
65 door arm
66 spring

The invention claimed is:

1. A microwave heating device comprising:
a cavity housing an object to be heated;
a door openably provided on a front surface of the cavity;
a first microwave generator and a second microwave generator that generate microwaves;
an inverter unit that drives the first microwave generator and the second microwave generator;
a cooling unit that cools the first microwave generator and the second microwave generator and the inverter unit;
a first waveguide that supplies, to the cavity, the microwave generated by the first microwave generator; and
a second waveguide that supplies, to the cavity, the microwave generated by the second microwave generator, wherein
the first microwave generator and the second microwave generator are disposed side by side in a right-left direction below a bottom surface of the cavity,
both the first microwave generator and the second microwave generator are disposed at a back side away from the front surface of the cavity,
the cooling unit is disposed at a front side toward the back side,
the inverter unit is disposed between both the first microwave generator and the second microwave generator and the cooling unit, and
the first waveguide and the second waveguide are provided above the first microwave generator, the second microwave generator and the inverter unit so as to extend in a front-back direction from the first microwave generator and the second microwave generator, respectively.

2. The microwave heating device according to claim 1, further comprising a convection device that is provided behind the cavity to be communicated with the cavity, and supplies hot air to the cavity, wherein
the first and second microwave generators are provided below the convection device.

3. The microwave heating device according to claim 1, further comprising an outside air suction port for taking outside air in, the outside air suction port being provided below the door, wherein
the cooling unit and the inverter unit are provided below the cavity.

4. The microwave heating device according to claim 1, wherein
the first and second waveguides have first and second microwave radiation holes that are openings for supplying microwaves into the cavity, respectively, and have H corner shapes curved toward the first and second microwave radiation holes at 90 degrees, respectively.

* * * * *